US011605890B2

(12) United States Patent
West

(10) Patent No.: US 11,605,890 B2
(45) Date of Patent: Mar. 14, 2023

(54) SHORT DUAL-DRIVEN GROUNDLESS ANTENNAS

(71) Applicant: Laurice J. West, Ventura, CA (US)

(72) Inventor: Laurice J. West, Ventura, CA (US)

( * ) Notice: Subject to any disclaimer, the term of this patent is extended or adjusted under 35 U.S.C. 154(b) by 205 days.

(21) Appl. No.: 17/083,142

(22) Filed: Oct. 28, 2020

(65) Prior Publication Data

US 2021/0075111 A1 Mar. 11, 2021

Related U.S. Application Data

(63) Continuation of application No. 15/925,162, filed on Mar. 19, 2018, now Pat. No. 10,826,179.

(51) Int. Cl.

| | |
|---|---|
| ***H01Q 1/40*** | (2006.01) |
| ***H01Q 7/00*** | (2006.01) |
| ***H01Q 7/08*** | (2006.01) |
| ***H01Q 9/22*** | (2006.01) |

(52) U.S. Cl.

CPC ..... *H01Q 7/08* (2013.01); *H01Q 1/40* (2013.01); *H01Q 7/005* (2013.01); *H01Q 9/22* (2013.01)

(58) Field of Classification Search

CPC ..... H01Q 7/08; H01Q 1/40; H01Q 7/005; H01Q 9/22; H01Q 13/08; H01Q 21/08

See application file for complete search history.

(56) References Cited

U.S. PATENT DOCUMENTS

| | | | |
|---|---|---|---|
| 3,312,976 A | 4/1967 | Gregory | |
| 3,871,000 A | 3/1975 | Tymann | |
| 4,254,422 A | 3/1981 | Kloepfer et al. | |
| 4,366,485 A | 12/1982 | Hodgkinson | |

(Continued)

FOREIGN PATENT DOCUMENTS

| | | |
|---|---|---|
| DE | 20304267 U1 | 7/2003 |
| GB | 2257836 A | 1/1993 |
| WO | 0241449 A2 | 5/2002 |

OTHER PUBLICATIONS

DX Engineering, "DX Engineering TW Antenna 40 Meter Solo Explorer Packages DXE-TW-4040-P", Jan. 18, 2018, pp. 2, DX Engineering, retrieved at <<https://www.dxengineering.com/parts/dxe-tw-4040-p>>.

(Continued)

*Primary Examiner* — Hai V Tran
*Assistant Examiner* — Michael M Bouizza
(74) *Attorney, Agent, or Firm* — Lyon & Harr, LLP; Richard T. Lyon

(57) ABSTRACT

Short, dual-driven groundless antennas are provided. One of the antennas includes a tubular outer conductor, a tubular inner conductor, and an electrical connector that electrically connects an opposite end of the outer conductor to the exterior of the inner conductor. The inner conductor is longitudinally disposed within the hollow axial interior of the outer conductor such that an axial gap exists between the radially inner surface of the outer conductor and the radially outer surface of the inner conductor, and the inner conductor runs at least to the opposite end of the outer conductor. Electrical signals are connected to a driven end of both the outer and inner conductors, where these signals supply power to/from the antenna whenever it is used as a transmitter/receiver, and neither of these signals needs to be connected to an electrical ground.

1 Claim, 11 Drawing Sheets

(56) References Cited

U.S. PATENT DOCUMENTS

| | | | | |
|---|---|---|---|---|
| 4,443,804 | A | 4/1984 | Smith | |
| 4,479,130 | A * | 10/1984 | Snyder | H01Q 21/08 343/822 |
| 4,963,879 | A | 10/1990 | Lin | |
| 5,276,457 | A | 1/1994 | Agarwal et al. | |
| 5,353,036 | A | 10/1994 | Baldry | |
| 5,617,105 | A | 4/1997 | Tsunekawa et al. | |
| 6,181,286 | B1 | 1/2001 | Roscoe et al. | |
| 6,963,313 | B2 | 11/2005 | Du | |
| 7,990,322 | B1 | 8/2011 | Nalbandian | |
| 8,108,028 | B2 | 1/2012 | Karmarkar | |
| 8,230,581 | B1 | 7/2012 | Wilcoxon et al. | |
| 8,878,629 | B2 | 11/2014 | Gehring et al. | |
| 9,083,076 | B2 | 7/2015 | Parsche | |
| 9,300,042 | B2 | 3/2016 | Rogers et al. | |
| 9,598,945 | B2 | 3/2017 | Okoniewski | |
| 2003/0189526 | A1 * | 10/2003 | Gustafson | H01Q 9/22 343/792 |
| 2010/0283699 | A1 * | 11/2010 | Apostolos | H01Q 5/40 343/792 |
| 2012/0125607 | A1 * | 5/2012 | Parsche | H01Q 9/24 166/57 |
| 2014/0247193 | A1 | 9/2014 | Parsche | |
| 2015/0322759 | A1 | 11/2015 | Okoniewski | |

OTHER PUBLICATIONS

Kudrin, et al., "Insulated Cylindrical Antenna in a Cold Magnetoplasma", Progress in Electromagnetics Research, 2005, pp. 135-166, PIER 5 3, retrieved at <<jpier.org/PIER/pier53/08.0409011.Kudrin.PKZ.pdf>>.

U.S. Office Action, U.S. Appl. No. 15/925,162, dated Apr. 14, 2020, pp. 1-9.

U.S. Notice of Allowance, U.S. Appl. No. 15/925,162, dated Aug. 5, 2020, pp. 1-9.

* cited by examiner

SHORT DUAL-DRIVEN GROUNDLESS ANTENNAS

CROSS REFERENCE TO RELATED APPLICATION

This application claims the benefit of and priority to U.S. patent application Ser. No. 15/925,162 filed Mar. 19, 2018.

BACKGROUND

A radio wave is a type of electromagnetic radiation (e.g., a type of electromagnetic wave/energy) that travels through free space and has a wavelength that is within the electromagnetic spectrum and is generally longer than the wavelength of infrared light. For example, radio waves generally have frequencies that are less than or equal to 300 gigahertz. As such, radio waves generally have wavelengths that are greater than or equal to 1 millimeter. Naturally occurring radio waves are generated by lightning and astronomical objects. Radio waves can also be artificially generated. Artificially generated radio waves are used in many different applications such as fixed and mobile radio communication, broadcasting of audio and video content, radar, navigation, and computer data communication over many different types of wireless networks. Antennas are commonly used to transmit or receive radio waves.

SUMMARY

In one exemplary antenna implementation described herein the antenna includes an elongated tubular outer electrical conductor having a driven end and an opposite end. The antenna also includes an elongated tubular inner electrical conductor having a driven end, an opposite end, and a radially cross-sectional shape and size that allow the tubular inner electrical conductor to be longitudinally disposed within a hollow axial interior of the tubular outer electrical conductor without coming into contact with a radially inner surface of the tubular outer electrical conductor. The tubular inner electrical conductor is longitudinally disposed within the interior of the tubular outer electrical conductor such that an axial gap exists between the inner surface of the tubular outer electrical conductor and a radially outer surface of the tubular inner electrical conductor, where the tubular inner electrical conductor runs at least to the opposite end of the outer electrical conductor. A first electrical signal is electrically connected to the driven end of the outer electrical conductor, and a second electrical signal is electrically connected to the driven end of the tubular inner electrical conductor, where the first and second electrical signals supply input power to the antenna whenever it is used as a transmitter, these signals supply output power from the antenna whenever it is used as a receiver, and neither of these signals needs to be connected to an electrical ground. The antenna also includes an electrical connector that electrically connects the opposite end of the outer electrical conductor to an exterior of the tubular inner electrical conductor.

In another exemplary antenna implementation described herein the antenna includes an elongated tubular electrical conductor having a driven end and an opposite end. The antenna also includes an elongated inner electrical conductor having a solid axial interior, a driven end, an opposite end, and a radially cross-sectional shape and size that allow the inner electrical conductor to be longitudinally disposed within a hollow axial interior of the tubular electrical conductor without coming into contact with a radially inner surface of the tubular electrical conductor. The inner electrical conductor is longitudinally disposed within the interior of the tubular electrical conductor such that an axial gap exists between the inner surface of the tubular electrical conductor and a radially outer surface of the inner electrical conductor. The interior of the tubular electrical conductor is exposed on the driven end thereof. The opposite end of the inner electrical conductor is electrically connected to the opposite end of the tubular electrical conductor, where the nature of this electrical connection results in the interior of the tubular electrical conductor being exposed on the opposite end thereof.

In another exemplary antenna implementation described herein An antenna for transmitting radio waves includes two or more individual elongated antennas that are disposed end-to-end along a common longitudinal axis. Each of the antennas includes an elongated tubular electrical conductor having an opposite end, and an elongated inner electrical conductor having an opposite end and a radially cross-sectional shape and size that allow the inner electrical conductor to be longitudinally disposed within a hollow axial interior of the tubular electrical conductor without coming into contact with a radially inner surface of the tubular electrical conductor. The inner electrical conductor is longitudinally disposed within the interior of the tubular electrical conductor such that an axial gap exists between the inner surface of the tubular electrical conductor and a radially outer surface of the inner electrical conductor. The opposite end of the inner electrical conductor is electrically connected to the opposite end of the tubular electrical conductor. Each of the antennas is tuned differently such that each of the antennas transmits one of, a different frequency band, or a common frequency band at a different phase or a common phase.

It should be noted that the foregoing Summary is provided to introduce a selection of concepts, in a simplified form, that are further described below in the Detailed Description. This Summary is not intended to identify key features or essential features of the claimed subject matter, nor is it intended to be used as an aid in determining the scope of the claimed subject matter. Its sole purpose is to present some concepts of the claimed subject matter in a simplified form as a prelude to the more-detailed description that is presented below.

DESCRIPTION OF THE DRAWINGS

The specific features, aspects, and advantages of the antenna implementations described herein will become better understood with regard to the following description, appended claims, and accompanying drawings where:

DETAILED DESCRIPTION

Figure 1:
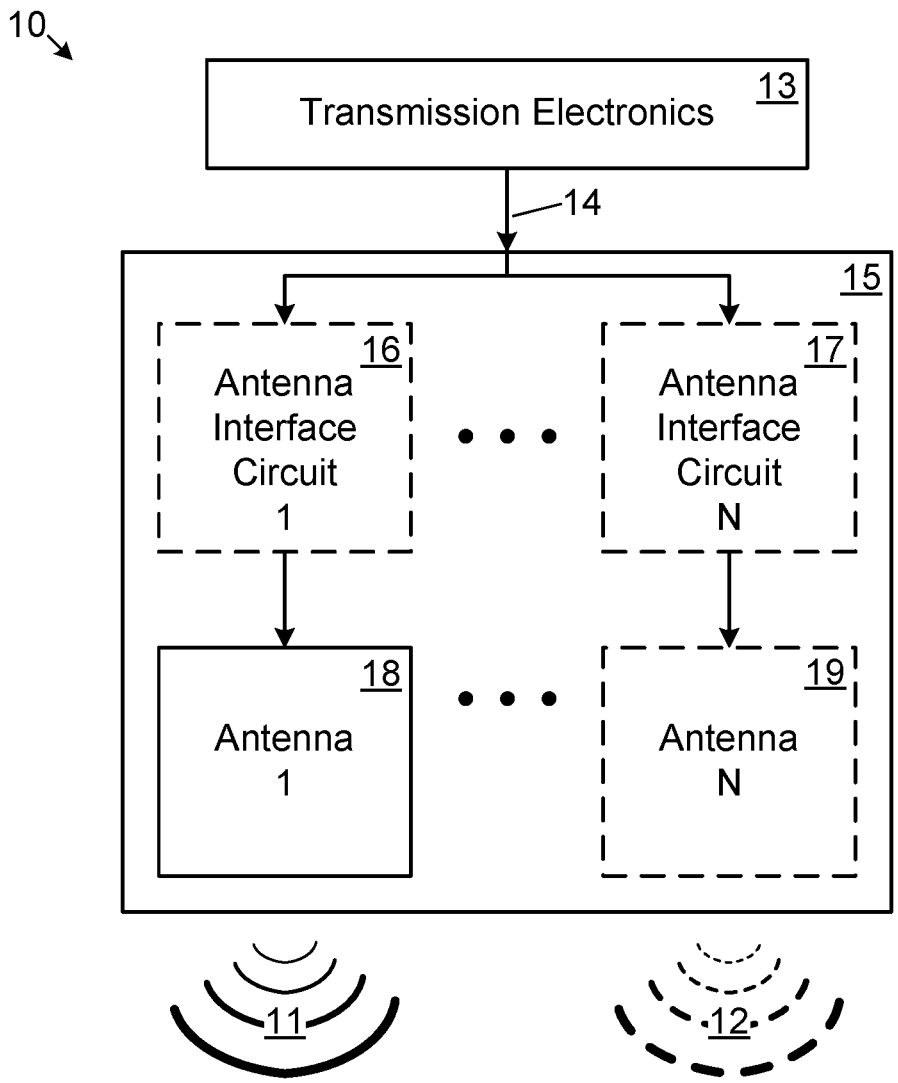
FIGS. 1 and 2 are diagrams illustrating two different exemplary implementations, in simplified form, of a suitable system environment in which the antenna implementations described herein can be realized.

In the following description of antenna implementations reference is made to the accompanying drawings which form a part hereof, and in which are shown, by way of illustration, specific implementations in which the antenna can be practiced. It is understood that other implementations can be utilized and structural changes can be made without departing from the scope of the antenna implementations.

It is also noted that for the sake of clarity specific terminology will be resorted to in describing the antenna implementations described herein and it is not intended for these implementations to be limited to the specific terms so chosen. Furthermore, it is to be understood that each specific term includes all its technical equivalents that operate in a broadly similar manner to achieve a similar purpose. Reference herein to "one implementation", or "another implementation", or an "exemplary implementation", or an "alternate implementation", or "one version", or "another version", or an "exemplary version", or an "alternate version", or "one variant", or "another variant", or an "exemplary variant", or an "alternate variant" means that a particular feature, a particular structure, or particular characteristics described in connection with the implementation/version/variant can be included in at least one implementation of the antenna. The appearances of the phrases "in one implementation", "in another implementation", "in an exemplary implementation", "in an alternate implementation", "in one version", "in another version", "in an exemplary version", "in an alternate version", "in one variant", "in another variant", "in an exemplary variant", and "in an alternate variant" in various places in the specification are not necessarily all referring to the same implementation/version/variant, nor are separate or alternative implementations/versions/variants mutually exclusive of other implementations/versions/variants. Yet furthermore, the order of process flow representing one or more implementations, or versions, or variants of the antenna does not inherently indicate any particular order nor imply any limitations of the antenna.

Furthermore, to the extent that the terms "includes," "including," "has," "contains," variants thereof, and other similar words are used in either this detailed description or the claims, these terms are intended to be inclusive, in a manner similar to the term "comprising", as an open transition word without precluding any additional or other elements.

1.0 Short Dual-Driven Groundless Antennas

As described heretofore, antennas are commonly used to transmit or receive radio waves (e.g., electromagnetic waves/energy). In other words antennas are transducers. As is appreciated in the arts of antennas and electromagnetic radiation, and as will be described in more detail hereafter, a given antenna acts as a circuit having inductance, capacitance and resistance. A given antenna operating as a transmitter generally converts a time-varying, and as such current-varying, electrical signal having a prescribed frequency or frequencies to a radio wave having substantially the same frequency/frequencies. A given antenna operating as a receiver generally converts one or more radio waves having a prescribed frequency or frequencies to a time-varying electrical signal having substantially the same frequency or frequencies.

Antennas operating in the range from very low frequencies to ultra high frequencies currently exist in the form of conventional half-wavelength dipole designs and conventional quarter-wavelength grounded vertical (also known as monopole) designs, among other types of conventional antenna designs. Dipole and monopole designs are named by the number of open, non-connected ends. When the length of a given antenna is long, which is the case in the just-described dipole and monopole designs, current flow on the antenna naturally decreases toward the open, non-connected end(s) of the antenna. More particularly, current flow near a given open, non-connected end of a dipole or monopole antenna is merely a displacement current through the capacitance to the opposite end of the antenna, which is a ground circuit in the case of a grounded monopole design. Various conventional techniques exist for controlling the current flow near the open, non-connected end(s) of an antenna. These techniques including using series coils and capacitive "hat" structures at the open, non-connected ends.

The antenna implementations described herein are generally applicable to transmitting or receiving radio waves. Generally speaking and as will be appreciated from the more-detailed description that follows, the antenna implementations are substantially straight and have a length that is short with respect to the wavelength(s) of the radio waves that are being transmitted or received by the antenna implementations. In other words, the antenna implementations generally have a length that is much shorter than the wavelength(s) of the radio wave(s) that is being transmitted or received by the antenna implementations. For example, and as will be described in more detail hereafter, although the antenna implementations can have a wide variety of lengths, the antenna implementations may have a length that is as short as 0.025 lambda. As such, the antenna implementations provide a high level of performance (e.g., a high degree of transmitted or received power with very low loss) in a very compact size.

As will also be appreciated from the more-detailed description that follows, the antenna implementations described herein differ from conventional monopole and dipole antenna designs in that both ends of the antenna implementations are connected to a power transmitting source or a power receiver. In other words, the antenna implementations are dual-driven. Each of the antenna implementations described herein provides high current flow over its entire length since the outer radiating surface of the short, tubular structure of each of the antenna implementations is actively driven at both of its ends, where the driving power connections at both ends are made by conducting paths located inside this tubular structure. These inside conducting paths and the outer radiating surface are shielded from each other by being opposite sides of the tubular structure. Some impedance matching can also be accomplished using the shielded inner structure of the antenna implementations.

As will also be appreciated from the more-detailed description that follows, the antenna implementations described herein also do not need to be grounded or utilize ground radials, as is the case with conventional antenna designs. In other words, the antenna implementations are groundless. The antenna implementations also do not rely upon the use of capacitive hats or series coils to control the length of the antenna implementations, or to generate high current flow toward the ends of the antenna implementations, as is often done in conventional antenna designs. The antenna implementations can also be frequency-tuned without changing their length.

The antenna implementations described herein are advantageous for various reasons including, but not limited to, the following. As will also be appreciated from the more-detailed description that follows, the antenna implementations can be used as both a transmitter and receiver of radio waves. The aforementioned fact that the antenna implementations are substantially straight and have a length that is short or very short with respect to the wavelength(s) of the radio waves that are being transmitted or received allows the antenna implementations to be used in applications where the size of the antenna is a concern. For example, the antenna implementations are ideally suited for use on boats, cars and airplanes, and by ham radio operators living in an apartment, among many other types of antenna applications. The very small size of the antenna implementations allows them to be integrated directly into a hand-held device without the need for an intermediate transmission line. The aforementioned fact that the antenna implementations do not need to be grounded or utilize ground radials reduces loss in the radio waves that are transmitted by the antenna implementations, and also reduces loss in the electrical signals that are received from the antenna implementations when they are used to receive radio waves. This ability to operate without a ground or ground radials also allows the antenna implementations to be used in applications where no ground is available—for example, the antenna implementations can be used on a plastic or wooden boat that doesn't have a ground. The antenna implementations are suitable for use in hand-held telephones and hand-held radios, and in these particular applications radiation from or to the antenna implementations does not directly depend on a user's hand or body to act as part of the antenna circuit (which has various health benefits to the user). The antenna implementations generally operate in a selected narrow or very narrow frequency band the width of which can be increased or decreased using conventional frequency tuning methods. Since the antenna implementations do not rely upon using capacitive coupling to an open end, the antenna implementations are less affected by materials, be they conducting or insulating, near the antenna.

As is appreciated in the art of antennas, conventional antenna designs may lose up to 90 percent of their input power due to their ground connection. Since the antenna implementations described herein are groundless they do not suffer from this issue and thus are much more efficient and offer a higher level of performance than conventional antenna designs. Additionally and as will also be appreciated from the more-detailed description that follows, the antenna implementations allow currents of the same frequency to propagate in different modes on a common surface of the antenna implementations without any interference occurring between these different propagation modes, thus optimizing the performance of the antenna implementations. The antenna implementations also allow for frequency/phase tuning and impedance matching with a minimum of added components. The antenna implementations can also be realized in a wide variety of lengths, although a trade-off exists between length and the value of the radiation resistance. The antenna implementations can also be incorporated into any type of conventional antenna design. By way of example but not limitation, by substituting any one or more of the antenna implementations for one or more of the elements of a given conventional antenna design very small antennas with the characteristics of a Yagi and/or log periodic antenna can be built.

Figure 2:
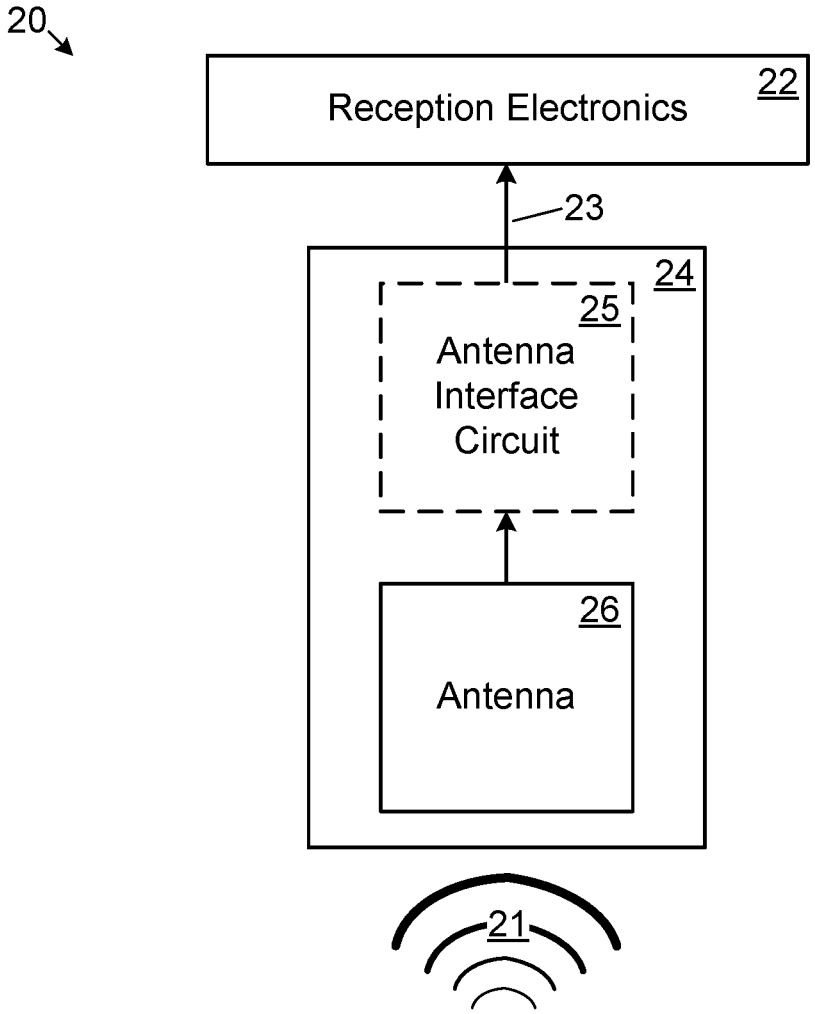

FIGS. 1 and 2 illustrate two different exemplary implementations, in simplified form, of a suitable system environment in which the antenna implementations described herein can be realized. The system environments shown in FIGS. 1 and 2 are just two examples of suitable system environments and are not intended to suggest any limitation as to the scope of use or functionality of the antenna implementations (e.g., various other system environments are also possible). Neither should the system environments exemplified in FIGS. 1 and 2 be interpreted as having any dependency or requirement relating to any one or combination of the components discussed hereafter in this section.

More particularly, FIG. 1 illustrates an exemplary implementation, in simplified form, of a suitable system environment 10 for using the antenna implementations described herein to transmit one or more radio waves 11/12 into free space. As exemplified in FIG. 1, the system environment 10 generally includes transmission electronics 13 that supply input power to an antenna subsystem 15 via a power coupling cable 14. In one version of the antenna implementations the power coupling cable 14 can be a conventional coaxial cable having a known impedance. In another version of the antenna implementations the power coupling cable 14 can be a conventional window line (also known as twin-lead) cable having a known impedance. The antenna subsystem 15 includes one or more antennas 18/19 each of which converts the input power supplied by the transmission electronics 13 to a radio wave 11/12 that is transmitted into free space. As will be described in more detail hereafter, in the case where the antenna subsystem 15 includes a plurality of antennas 18/19, each of the antennas 18/19 may be frequency-tuned and/or phase-tuned to have different transmission characteristics so that each of the radio waves 11/12 that is transmitted from the subsystem 15 has different characteristics. The antenna subsystem 15 can optionally include one or more antenna interface circuits 16/17 each of which can be used to couple the input power supplied by the power coupling cable 14 to a different one of the antennas 18/19. As will also be described in more detail hereafter, a given antenna interface circuit 16/17 can be used to modify the input impedance of the antenna 18/19 to which it is connected in order to help match this input impedance to the impedance of the power coupling cable 14 (e.g., the antenna interface circuit 16/17 can perform an impedance matching function). In other words, the design of each antenna interface circuit 16/17 can be specifically tailored to the input impedance characteristics of the antenna 18/19 to which the interface circuit 16/17 is connected (e.g., the design of the circuit 16 can be specifically tailored to the input impedance characteristics of the antenna 18, and the design of the circuit 17 can be specifically tailored to the input impedance characteristics of the antenna 19). As such, a given antenna interface circuit 16/17 can advantageously serve to couple the input power supplied by the transmission electronics 13 to a given antenna 18/19 with minimal loss, thus maximizing the performance of the antenna subsystem 15 by maximizing the power of the radio wave 11/12 that is transmitted by the antenna 18/19. A given antenna interface circuit 16/17 can also be used to tune the transmission characteristics (e.g., the desired frequency band to be transmitted and the phase thereof) of the antenna 18/19 to which it is connected.

FIG. 2 illustrates an exemplary implementation, in simplified form, of a suitable system environment 20 for using the antenna implementations described herein to receive a radio wave 21 that is traveling through free space. As exemplified in FIG. 2, the system environment 20 generally includes reception electronics 22 that receive output power from an antenna subsystem 24 via a power coupling cable 23. In one version of the antenna implementations the power coupling cable 23 can be a conventional coaxial cable having a known input impedance. In another version of the antenna implementations the power coupling cable 23 can be a conventional window line (also known as twin-lead) cable having a known input impedance. The antenna subsystem 24 includes an antenna 26 that receives the radio wave 21 and converts it into the output power which is supplied to the reception electronics 22 via the power coupling cable 23. The antenna subsystem 24 can optionally include an antenna interface circuit 25 that can be used to couple the output power supplied by the antenna 26 to the power coupling cable 23. As will be described in more detail hereafter, the antenna interface circuit 25 can be used to modify the output impedance of the antenna 26 in order to help match this output impedance to the impedance of the power coupling cable 23 (e.g., the antenna interface circuit 25 can perform an impedance matching function). As such, the antenna interface circuit 25 can advantageously serve to couple the output power supplied by the antenna 26 to the reception electronics 22 with minimal loss, thus maximizing the performance of the antenna subsystem 24 by maximizing the power of the radio wave 21 that is received by the reception electronics 22. The antenna interface circuit 25 can also be used to tune the reception characteristics (e.g., the desired frequency band to be received and the phase thereof) of the antenna 26.

Referring again to FIGS. 1 and 2, various exemplary implementations of the antenna 18/19/26 and the antenna interface circuit 16/17/25 will now be described in more detail. It is noted that each of the antennas 18/19/26 can be any one of the different antenna implementations that are described in more detail hereafter. As will also be described in more detail hereafter, each of the antennas 18/19/26 can also be an interconnected combination of two or more of the different antenna implementations that are described in more detail hereafter.

1.1 Short Dual-Driven Groundless Antenna Having Solid Inner Conductor

Figure 3:
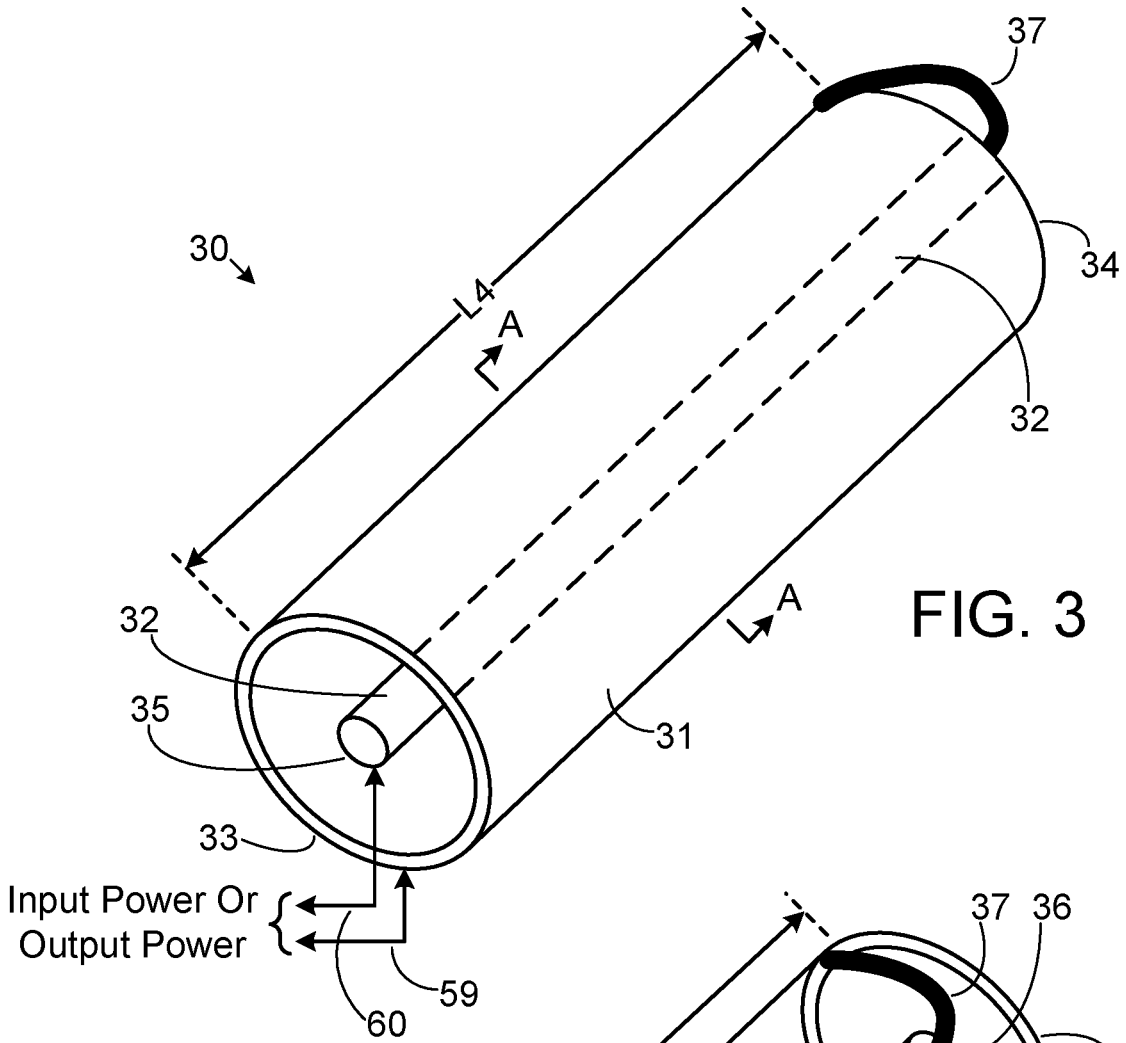
FIG. 3 is a diagram illustrating a longitudinal, partially transparent, plan view, in simplified form, of an exemplary implementation of a short dual-driven groundless antenna that includes an inner electrical conductor having a solid axial interior, where the view shown in FIG. 3 is taken from the perspective of the driven end of the antenna.
Figure 4:
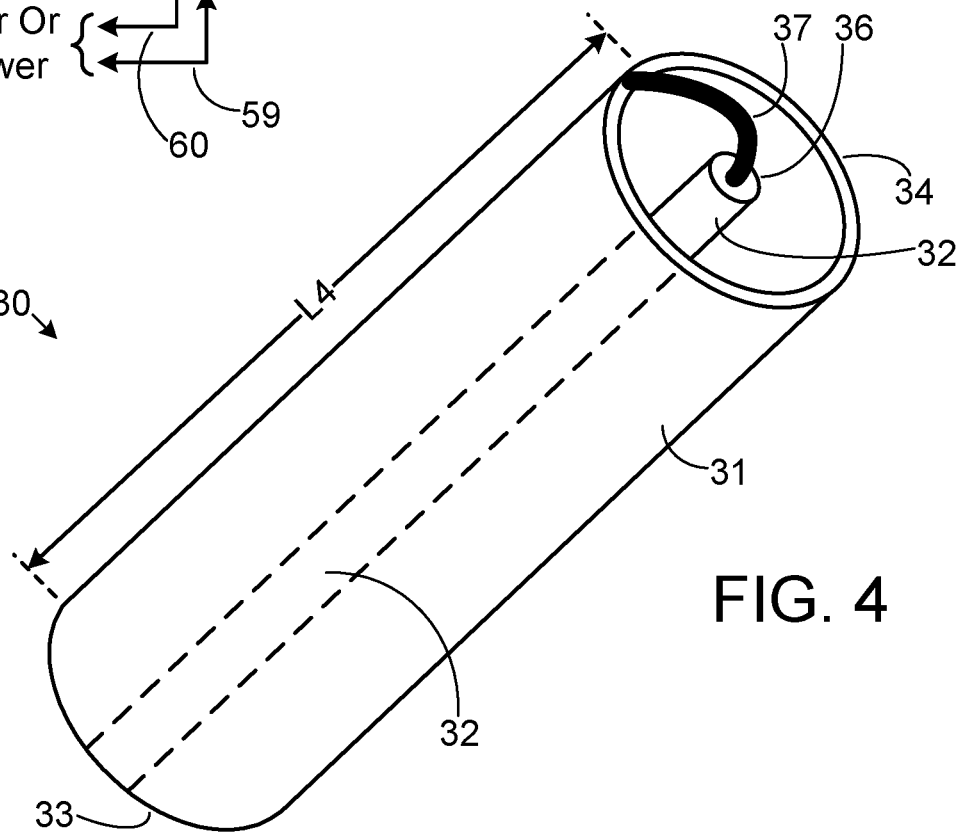
FIG. 4 is a diagram illustrating another longitudinal, partially transparent, plan view, in simplified form, of the antenna of FIG. 3, where the view shown in FIG. 4 is taken from the perspective of the opposite end of the antenna.
Figure 5:
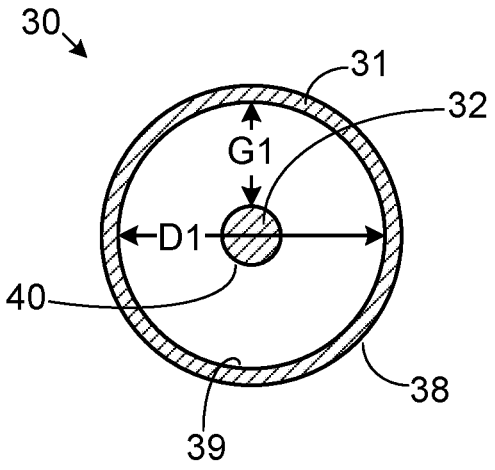
FIG. 5 is a diagram illustrating a cross-sectional view, in simplified form, of the antenna of FIGS. 3 and 4 taken along line A-A of FIG. 3.

FIG. 3 illustrates a longitudinal, partially transparent, plan view, in simplified form, of an exemplary implementation of a short dual-driven groundless antenna 30 that includes an elongated inner electrical conductor 32 having a solid axial interior, where the view shown in FIG. 3 is taken from the perspective of the driven end 33/35 of the antenna 30. FIG. 4 illustrates another longitudinal, partially transparent, plan view, in simplified form, of the antenna 30 of FIG. 3, where the view shown in FIG. 4 is taken from the perspective of the opposite end 34/36 of the antenna 30. FIG. 5 illustrates a cross-sectional view, in simplified form, of the antenna 30 of FIGS. 3 and 4 taken along line A-A of FIG. 3.

As exemplified in FIGS. 3-5, in addition to the elongated inner electrical conductor 32 the antenna 30 also includes an elongated tubular electrical conductor 31 having a prescribed length L4, where the hollow axial interior of the tubular conductor 31 has a prescribed diameter D1. The term "tubular" is used herein to refer to a conductor that has a hollow axial interior and can have any radially cross-sectional shape. The tubular conductor 31 has a driven end 33 and an opposite end 34. The inner conductor 32 also has a driven end 35 and an opposite end 36. The inner conductor 32 has a radially cross-sectional shape and size that allow it to be longitudinally disposed within the hollow axial interior of the tubular conductor 31 without coming into contact with the radially inner surface 39 of the tubular conductor 31. The inner conductor 32 is longitudinally disposed within the hollow axial interior of the tubular conductor 31 such that an axial gap G1 exists between the radially inner surface 39 of the tubular conductor 31 and the radially outer surface 40 of the inner conductor 32. The interior of the tubular conductor 31 is exposed on the driven end 33 thereof. In the particular implementation of the antenna 30 that is shown in FIGS. 3 and 4 the inner conductor 32 has substantially the same length L4 as the tubular conductor 31 and the inner conductor 32 runs from the driven end 33 of the tubular conductor 31 all the way to the opposite end 34 of the tubular conductor 31. Alternate implementations of the antenna (not shown) are also possible where the length of the inner conductor is shorter than the length of the tubular conductor so that the driven end of the tubular conductor extends beyond the driven end of the inner conductor and/or the opposite end of the tubular conductor extends beyond the opposite end of the inner conductor. As will be described in more detail hereafter, a first electrical signal 59 is electrically connected to the driven end 33 of the tubular conductor 31, and a second electrical signal 60 is electrically connected to the driven end 35 of the inner conductor 32, where the first and second electrical signals 59/60 supply input power to the antenna 30 whenever it is used as a transmitter, these signals 59/60 supply output power from the antenna 30 whenever it is used as a receiver, and neither of these signals 59/60 needs to be connected to an electrical ground (e.g., an earth ground, or a chassis ground, or a system ground, or any other type of electrical ground).

Referring again to FIGS. 3-5, the opposite end 36 of the elongated inner electrical conductor 32 is electrically connected 37 to the opposite end 34 of the elongated tubular electrical conductor 31, where the nature of this electrical connection 37 results in the interior of the tubular electrical conductor being exposed on the opposite end 34 thereof as shown in FIG. 4. In the particular implementation of the antenna 30 that is shown in FIGS. 3 and 4 this electrical connection 37 is a wire that creates a short circuit between the opposite end 36 of the inner conductor 32 and the opposite end 34 of the tubular conductor 31. Alternate implementations of the antenna (not shown) are also possible where the electrical connection between the opposite ends of the inner conductor and the tubular conductor is made in other ways. By way of example but not limitation, this electrical connection may include a series-connected capacitor or a series-connected inductor.

Referring again to FIGS. 3-5, the elongated inner electrical conductor 32 can be longitudinally disposed within the hollow axial interior of the elongated tubular electrical conductor 31 in various ways. By way of example but not limitation, in the version of the antenna 30 that is shown in FIGS. 3-5 the inner conductor 32 runs along the longitudinal axis of the tubular conductor 31 (e.g., the inner conductor 32 and the tubular conductor 31 are substantially concentric/coaxial). In another version of the antenna (not shown) the inner conductor runs along an axis that is substantially parallel to the longitudinal axis of the tubular conductor (e.g., the longitudinal axis of the inner conductor is offset a prescribed distance from the longitudinal axis of tubular conductor so that the inner conductor is not centered within the tubular conductor but rather runs closer to one side of the tubular conductor's radially inner surface than the other sides thereof). The aforementioned axial gap G1 that exists between the radially inner surface 39 of the tubular conductor 31 and the radially outer surface 40 of the inner conductor 32 can be filled with a dielectric material. In a tested version of the antenna 30 the dielectric material that filled the gap G1 was air. Other versions of the antenna 30 are also possible where various other dielectric materials can be used to fill the gap G1 such as nylon, a polycarbonate, or the like.

Referring again to FIGS. 3-5, the elongated inner electrical conductor 32 and the elongated tubular electrical conductor 31 can be constructed from any material which is durable and electrically conductive. By way of example but not limitation, in a tested version of the antenna 30 both the inner conductor 32 and the tubular conductor 31 were constructed from copper. Other versions of the antenna 30 are also possible where both the inner conductor 32 and the tubular conductor 31 are constructed from one of a variety of other metals (e.g., aluminum, stainless steel, brass, nickel alloys, gold, platinum, silver, or the like) or another type of durable, electrically conductive material. Yet other versions of the antenna 30 are possible where the inner conductor 32 and the tubular conductor 31 are constructed from different durable and electrically conductive materials. Another version of the antenna 30 is possible where the inner conductor 32 and the tubular conductor 31 are constructed in a manner that results in the antenna 30 being flexible along its longitudinal axis. For example, the inner conductor 32 and the tubular conductor 31 may be part of a conventional flexible coaxial cable.

Referring again to FIGS. 3-5, it will be appreciated that various trade-offs exist in selecting the type(s) of material(s) to be used for the elongated inner electrical conductor 32 and the elongated tubular electrical conductor 31. Examples of such trade-offs include cost, weight, and the manner in which electrical connections are made to the material(s). In the aforementioned case where the axial gap G1 is filled with air, depending on the length L4 of the tubular conductor 31 and the type(s) of material(s) that the tubular conductor 31 and inner conductor 32 are constructed from, one or more electrically non-conductive spacer elements (not shown) may be interposed in the gap G1 and spaced along the longitudinal axis of the tubular conductor 31, where each of these spacer elements serves to structurally hold the inner conductor 32 in place and keep it from coming in contact with the radially inner surface 39 of the tubular conductor 31. By way of example but not limitation, in the tested version of the antenna 30 where both the inner conductor 32 and the tubular conductor 31 were constructed from copper, plastic washers were employed for the spacer elements.

Referring again to FIGS. 1-3, in the case where the antenna 30 is being used as a radio wave transmitter the input power supplied by the transmission electronics 13 is electrically input to the antenna 30 at two different points, namely the driven end 33 of the elongated tubular electrical conductor 31 and the driven end 35 of the elongated inner electrical conductor 32. More particularly and as described heretofore, this input power may be supplied to the antenna 30 directly from the power coupling cable 14, or this input power may be supplied to the antenna 30 via the antenna interface circuit 16/17. Similarly, in the case where the antenna 30 is being used as a radio wave receiver the output power supplied by the antenna 30 is electrically output from the antenna 30 at the just-described two different points. More particularly and as also described heretofore, this output power may be supplied to the power coupling cable 23 directly from the antenna 30, or this output power may be supplied to the power coupling cable 23 via the antenna interface circuit 25. Exemplary implementations of the antenna interface circuit 16/17/25 will be described in more detail hereafter.

Referring again to FIGS. 3-5 and as will be appreciated from the more detailed description that follows, the entirety of the radially outer surface 38 of the elongated tubular electrical conductor 31 serves as the radio wave radiating surface of the antenna 30 when it is being used as a transmitter, and also serves as the radio wave collection surface of the antenna 30 when it is being used as a receiver—this serves to maximize the total radiating/collection surface area of the antenna 30, which maximizes the performance of the antenna despite its relatively short length L4. The tubular conductor's 31 outer surface 38 is of course electrically coupled as a continuous surface to the radially inner surface 39 of the tubular conductor 31. The tubular conductor's 31 inner surface 39 and the radially outer surface 40 of the elongated inner electrical conductor 32 form an isolation region/zone residing in the axial gap G1, where this isolation region/zone serves to isolate the antenna's radiating/collection surface 38 (and thus the different current paths that exist on, and the radio wave that is being transmitted from or received by, this radiating/collection surface 38) from the various current paths that exist on the axial interior of the tubular conductor 31. The various current paths that exist on the antenna 30 will be described in more detail hereafter.

Figure 6:
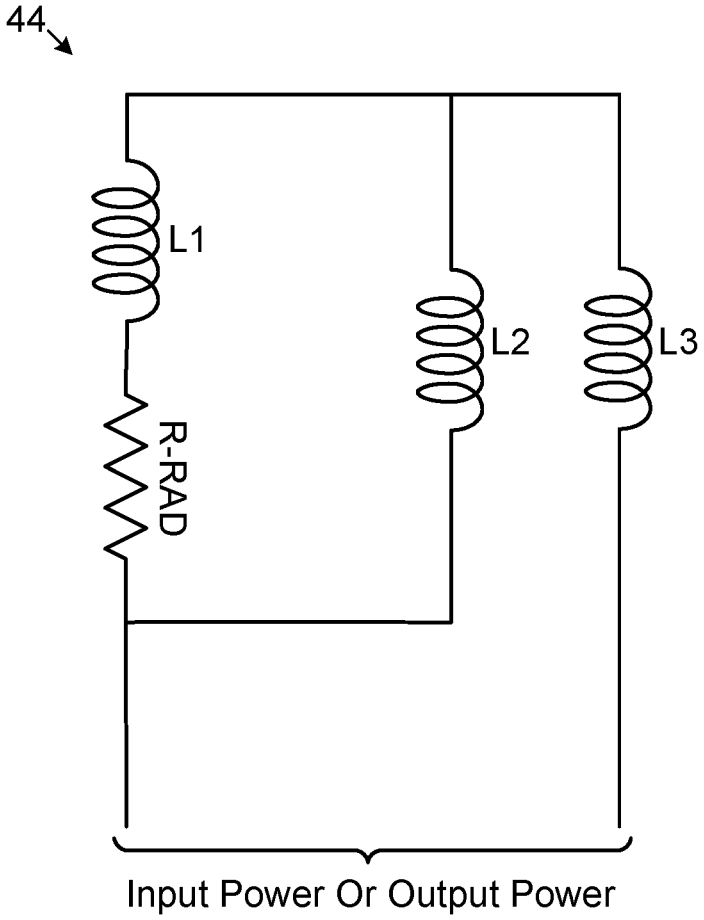
FIG. 6 is a schematic diagram illustrating a circuit approximation, in simplified form of the antenna of FIGS. 3-5.

FIG. 6 illustrates a circuit approximation 44, in simplified form, of the antenna 30 of FIGS. 3-5. As exemplified in FIG. 6 and referring again to FIGS. 3-5, L1 represents an approximation of the inductance of a current that flows on the radially outer surface 38 of the elongated tubular electrical conductor 31, and R-RAD represents an approximation of the radiation resistance of this particular current. L2 represents an approximation of the inductance of another current that flows on the radially inner surface 39 of the tubular conductor 31. L3 represents an approximation of the inductance of yet another current that flows on the radially outer surface 40 of the elongated inner electrical conductor 32. It is noted that additional currents also flow across the axial gap G1 between the driven end 33/35 to the opposite end 34/36 of the antenna 30. However, these additional currents across the axial gap G1 are not shown in FIG. 6 for simplicity sake. It is also noted that the circuit approximation 44 shown in FIG. 6 also generally applies to the other antenna implementations that are described in sections 1.2 and 1.3 that follow hereafter.

Referring again to FIGS. 3-5, various different modes of current flow (e.g., current propagation) are present in the antenna 30 that affect its operation. As will be appreciated from the more detailed description that follows, these different current flow modes cooperatively contribute to the operation, and the radio wave transmission and reception performance, of the antenna 30. A plurality of different mode of current flow may be present on a single surface of the antenna 30 at the same time. Examples of such current flow modes will now be described in more detail. It is noted that in addition to the exemplary current flow modes that are described in more detail hereafter, additional modes of current flow may also be present in the antenna 30 that do not significantly affect its operation. It is also noted that small losses associated with some of the current flows described hereafter are neglected for simplicity sake unless such losses are addressed specifically (e.g., the aforementioned R-RAD). Examples of such neglected small loses include the resistive loss that occurs on the current that flows on the radially inner surface 39 of the elongated tubular electrical conductor 31, and the resistive loss that occurs on the current that flows on the radially outer surface 40 of the elongated inner electrical conductor 32.

Referring again to FIGS. 3-5, one mode of current flow that is present in the antenna 30 is that of a conventional coaxial transmission line where the far end (e.g., the opposite end) of the transmission line is shorted. In this particular current flow mode power (e.g., a voltage and a current) that is input to the driven end 33/35 of the antenna 30 flows to the opposite end 34/36 of the antenna 30. Due to the electrical connection 37 (e.g., the short circuit) and the resulting impedance mismatch that exists at the opposite end 34/36 of the antenna 30, a portion of this input power is reflected at the opposite end 34/36 and flows back to the driven end 33/35 of the antenna 30. The input power and the reflected power pass by each other with no interference between them. In other words, the voltage and current associated with the input power and the voltage and current associated with the reflected power can add or subtract at the instant they pass by each other, but the propagation of the input power is otherwise not affected by the reflected power and vice versa.

Referring again to FIGS. 3-5, due to the electrical connection 37 that exists at the opposite end 34/36 of the antenna 30 and the fact that the length L4 of the antenna 30 is short or very short with respect to the wavelength(s) of the radio waves that are being transmitted or received by the antenna 30, for low-frequency-type modes of current propagation the radially inner surface 39 of the elongated tubular electrical conductor 31 and the elongated inner electrical conductor 32 operate as independent electrical conductors. As such, the following low frequency modes of current flow are also present in the antenna 30. Current flows from the driven end 33 of the tubular conductor 31 to the opposite end 34 thereof along the radially inner surface 39 of the tubular conductor 31, and current also flows from the driven end 35 of the inner conductor 32 to the opposite end 36 thereof, where some coupling occurs between these two unidirectional low frequency current flows. Current on the radially inner surface 39 of the tubular conductor 31 also flows in a direction that is opposite to the direction of low frequency current flow on the inner conductor 32, where some coupling also occurs between these two bidirectional low frequency current flows. The radially inner surface 39 of the tubular conductor 31 and the radially outer surface 38 of the tubular conductor 31 also operate as independent electrical conductors. As such, another mode of current flow is also present in the antenna 30 where current also flows from the opposite end 34 of the tubular conductor 31 to the driven end 33 thereof along the radially outer surface 38 of the tubular conductor 31.

Referring again to FIGS. 3-5, the just-described current flows that are present in the antenna 30 result in the radially outer surface 38 of the elongated tubular electrical conductor 31 being driven from both its driven end 33 and its opposite end 34. Accordingly, the antenna 30 transmits or receives a radio wave along the entirety of the radially outer surface 38 of the tubular conductor 31.

1.2 Short Dual-Driven Groundless Antenna Having Tubular Inner Conductor

Figure 7:
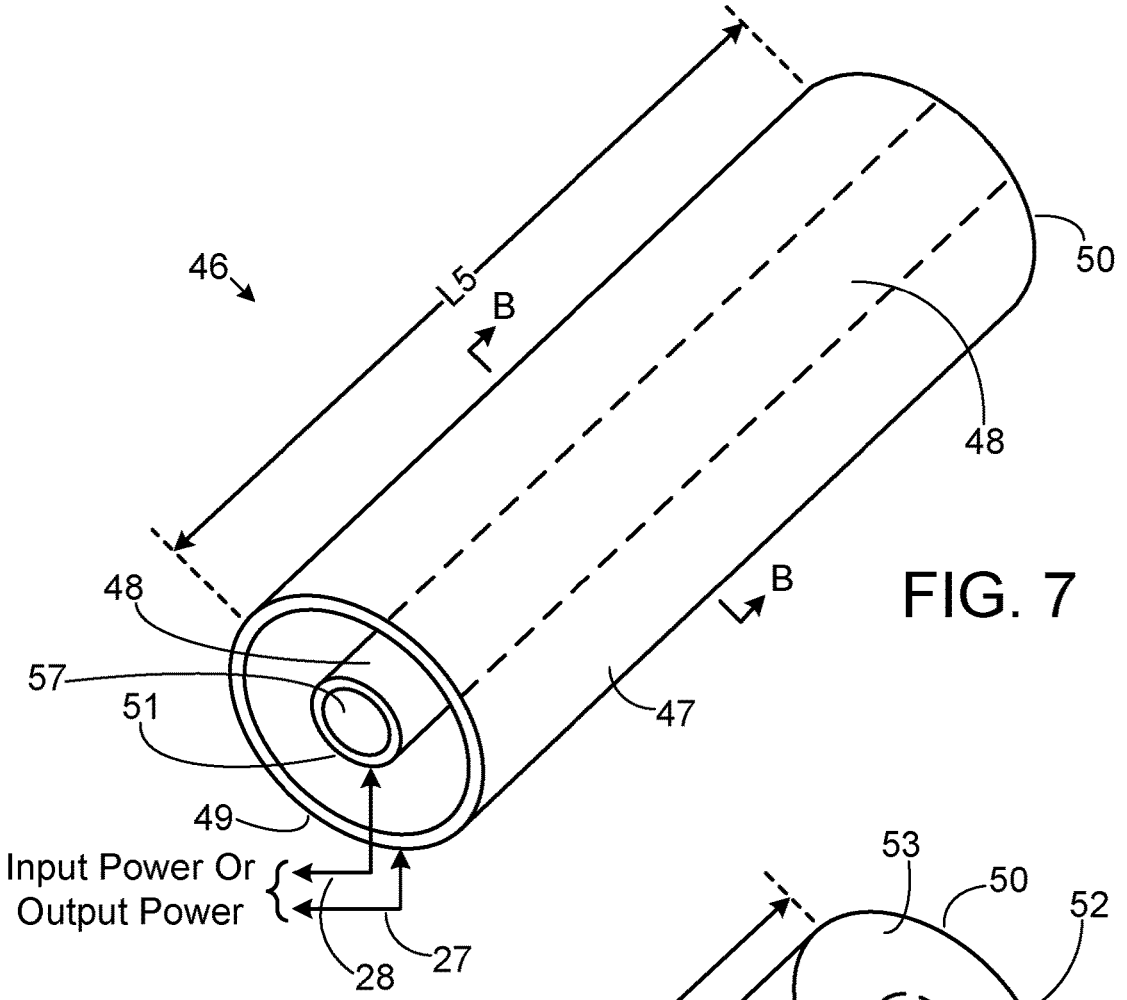
FIG. 7 is a diagram illustrating a longitudinal, partially transparent, plan view, in simplified form, of one implementation of a short dual-driven groundless antenna that includes a tubular inner conductor, where the view shown in FIG. 7 is taken from the perspective of the driven end of the antenna.
Figure 8:
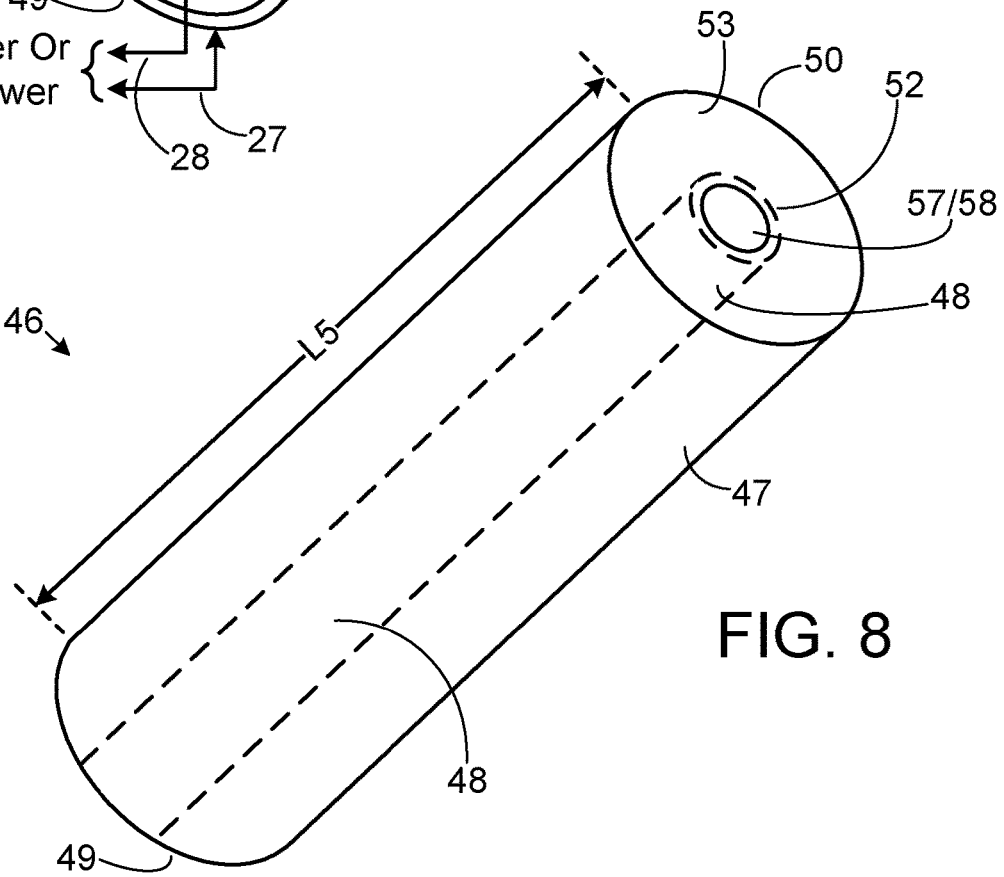
FIG. 8 is a diagram illustrating another longitudinal, partially transparent, plan view, in simplified form, of the antenna of FIG. 7, where the view shown in FIG. 8 is taken from the perspective of the opposite end of the antenna.
Figures 9, 10:
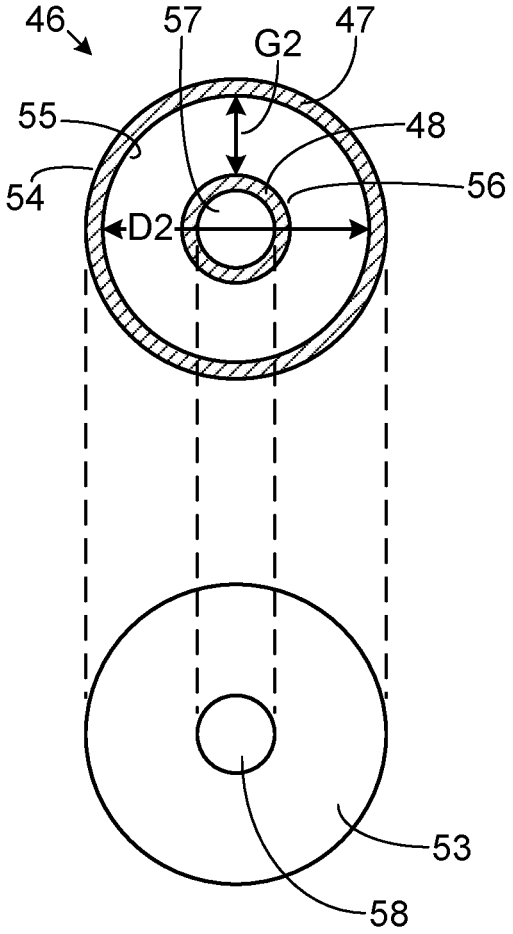
FIG. 9 is a diagram illustrating a cross-sectional view, in simplified form, of the antenna of FIGS. 7 and 8 taken along line B-B of FIG. 7.
FIG. 10 is a diagram illustrating a standalone plan view, in simplified form, of an exemplary implementation of an electrically conductive plate that can be disposed onto the opposite end of the antenna of FIGS. 7 and 8.

FIG. 7 illustrates a longitudinal, partially transparent, plan view, in simplified form, of one implementation of a short dual-driven groundless antenna 46 that includes an elongated tubular inner electrical conductor 48 (e.g., this conductor 48 has a hollow axial interior 57), where the view shown in FIG. 7 is taken from the perspective of the driven end 49/51 of the antenna 46. FIG. 8 illustrates another longitudinal, partially transparent, plan view, in simplified form, of the antenna 46 of FIG. 7, where the view shown in FIG. 8 is taken from the perspective of the opposite end 50/52 of the antenna 46. FIG. 9 illustrates a cross-sectional view, in simplified form, of the antenna 46 of FIGS. 7 and 8 taken along line B-B of FIG. 7. FIG. 10 illustrates a standalone plan view, in simplified form, of an exemplary implementation of an electrically conductive plate 53 that can be disposed onto the opposite 50/52 of the antenna 46 of FIGS. 7 and 8.

As exemplified in FIGS. 7-10, in addition to the elongated tubular inner electrical conductor 48 the antenna 46 also includes an elongated tubular outer electrical conductor 47 having a prescribe length L5, where the hollow axial interior of the outer conductor 47 has a prescribed diameter D2. The outer conductor 47 has a driven end 49 and an opposite end 50. The inner conductor 48 also has a driven end 51 and an opposite end 52. The inner conductor 48 has a radially cross-sectional shape and size that allow it to be longitudinally disposed within the hollow axial interior of the outer conductor 47 without coming into contact with the radially inner surface 55 of the outer conductor 47. The inner conductor 48 is longitudinally disposed within the hollow axial interior of the outer conductor 47 such that an axial gap G2 exists between the radially inner surface 55 of the outer conductor 47 and the radially outer surface 56 of the inner conductor 48. The interior of the outer conductor 47 and the interior 57 of the inner conductor 48 are exposed on the driven ends A/B 49/51 thereof. In the particular implementation of the antenna 46 that is shown in FIGS. 7 and 8 the inner conductor 48 has substantially the same length L5 as the outer conductor 47 and the inner conductor 48 runs all the way from the driven end 49 of the outer conductor 47 to the opposite end 50 thereof (e.g., the driven end 49 and driven end 51 are radially substantially aligned with each other, and the opposite end 50 and opposite end 52 are also radially substantially aligned with each other). Alternate implementations of the antenna (not shown) are also possible where the length of the inner conductor is shorter than the length of the outer conductor so that the driven end of the outer conductor extends beyond the driven end of the inner conductor and/or the opposite end of the outer conductor extends beyond the opposite end of the inner conductor. As will be described in more detail hereafter, a first electrical signal 27 is electrically connected to the driven end 49 of the tubular outer electrical conductor 47, and a second electrical signal 28 is electrically connected to the driven end 51 of the tubular inner electrical conductor 48, where the first and second electrical signals 27/28 supply input power to the antenna 46 whenever it is used as a transmitter, these signals 27/28 supply output power from the antenna 46 whenever it is used as a receiver, and neither of these signals 27/28 needs to be connected to an electrical ground.

Referring again to FIGS. 7-10, the antenna 46 also includes an electrical connector that electrically connects the opposite end 50 of the elongated tubular outer electrical conductor 47 to the exterior of the elongated tubular inner electrical conductor 48. In the version of the antenna 46 that is shown in FIGS. 7, 8 and 10 this electrical connector is realized as an electrically conductive plate 53 that is disposed onto the opposite end 50 of the outer conductor 47 as follows. The conductive plate 53 is electrically connected to the circumference or a part thereof of the opposite end 50 of the outer conductor 47, and can also be electrically connected to the exterior of the inner conductor 48 in various ways. By way of example but not limitation, in the particular implementation of the antenna 46 that is shown in FIGS. 7, 8 and 10 where the opposite ends 50/52 of the outer and inner conductors 47/48 are radially substantially aligned with each other, the plate 53 can be electrically connected to the circumference or a part thereof of the opposite end 52 of the inner conductor 48. In an alternate implementation of the antenna (not shown) where the opposite end of the inner conductor extends beyond the opposite end of the outer conductor, the plate can be electrically connected to the circumference or a part thereof of the radially outer surface of the inner conductor. As such, the conductive plate 53 serves to electrically short the exterior of the inner conductor 48 at or near the opposite end 52 thereof to the opposite end 50 of the outer conductor 47, and also serves to close the axial gap G2 on this opposite end 50. However, the conductive plate 53 includes an aperture 58 having a shape, a size, and a position on the plate 53 that generally allows the hollow axial interior 57 of the inner conductor 48 to pass through the plate 53. More particularly, in the version of the plate 53 that is shown in FIGS. 8 and 10, the aperture 58 has a shape and size that are substantially the same as the radially cross-sectional shape and size of the interior 57 of the inner conductor 48, and the aperture 58 is substantially centered over this interior 57. An alternate version of the plate (not shown) is also possible where the aperture has a shape and size that are substantially the same as the radially cross-sectional shape and size of the outer surface of the inner conductor, and the aperture is substantially centered over this outer surface, thus allowing the inner conductor to pass through the plate. An alternate version of the antenna (not shown) is also possible where the aforementioned electrical connector is realized as an inductor having a low value, or a capacitor.

Referring again to FIGS. 7-9, the elongated tubular inner electrical conductor 48 can be longitudinally disposed within the hollow axial interior of the elongated tubular outer electrical conductor 47 in various ways. By way of example but not limitation, in the version of the antenna 46 that is shown in FIGS. 7-9 the inner conductor 48 runs along the longitudinal axis of the outer conductor 47 (e.g., the inner conductor 48 and the outer conductor 47 are substantially concentric/coaxial). In another version of the antenna (not shown) the inner conductor runs along an axis that is substantially parallel to the longitudinal axis of the outer conductor (e.g., the longitudinal axis of the inner conductor is offset a prescribed distance from the longitudinal axis of the outer conductor so that the inner conductor is not centered within the outer conductor but rather runs closer to one side of the outer conductor's radially inner surface than the other sides thereof). The aforementioned axial gap G2 that exists between the radially inner surface 55 of the outer conductor 47 and the radially outer surface 56 of the inner conductor 48 can be filled with a dielectric material. In a tested version of the antenna 46 the dielectric material that filled the gap G2 was air. Other versions of the antenna 46 are also possible where various other dielectric materials can be used to fill the gap G2 such as nylon, a polycarbonate, or the like.

Referring again to FIGS. 7-9, the elongated tubular inner electrical conductor 48, the elongated tubular outer electrical conductor 47, and the electrically conductive plate 53 can be constructed from any material which is durable and electrically conductive. By way of example but not limitation, in a tested version of the antenna 46 the inner conductor 48, the outer conductor 47, and the plate 53 were constructed from copper. Other versions of the antenna 46 are also possible where the inner conductor 48, the outer conductor 47, and the plate 53 are constructed from one of a variety of other metals (e.g., aluminum, stainless steel, brass, nickel alloys, gold, platinum, silver, or the like) or another type of durable, electrically conductive material. Yet other versions of the antenna 46 are possible where the inner conductor 48, the outer conductor 47, and the plate 53 are constructed from different durable and electrically conductive materials. Another version of the antenna 46 is possible where the inner conductor 48 and the outer conductor 47 are constructed in a manner that results in the antenna 46 being flexible along its longitudinal axis. For example, the inner conductor 48 and the outer conductor 47 may be part of a conventional flexible coaxial cable. Advantages of this flexible implementation have been described heretofore.

Referring again to FIGS. 7-9, it will be appreciated that various trade-offs exist in selecting the type(s) of material(s) to be used for the elongated tubular inner electrical conductor 48, the elongated tubular outer electrical conductor 47, and the electrically conductive plate 53. Examples of such trade-offs include cost, weight, and the manner in which electrical connections are made to the material(s). In the aforementioned case where the axial gap G2 is filled with air, depending on the length L5 of the outer conductor 47 and the type(s) of material(s) that the outer conductor 47 and inner conductor 48 are constructed from, one or more electrically non-conductive spacer elements (not shown) may be interposed in the gap G2 and spaced along the longitudinal axis of the outer conductor 47, where each of these spacer elements serves to structurally hold the inner conductor 48 in place and keep it from coming in contact with the radially inner surface 55 of the outer conductor 47. By way of example but not limitation, in the tested version of the antenna 46 where both the inner conductor 48 and the outer conductor 47 were constructed from copper, plastic washers were employed for the spacer elements.

Referring again to FIGS. 1, 2 and 7, in the case where the antenna 46 is being used as a radio wave transmitter the input power supplied by the transmission electronics 13 is electrically input to the antenna 46 at two different points, namely the driven end 49 of the elongated tubular outer electrical conductor 47 and the driven end 51 of the elongated tubular inner electrical conductor 48. More particularly and as described heretofore, this input power may be supplied to the antenna 46 directly from the power coupling cable 14, or this input power may be supplied to the antenna 46 via the antenna interface circuit 16/17. Similarly, in the case where the antenna 46 is being used as a radio wave receiver the output power supplied by the antenna 46 is electrically output from the antenna 46 at the just-described two different points. More particularly and as also described heretofore, this output power may be supplied to the power coupling cable 23 directly from the antenna 46, or this output power may be supplied to the power coupling cable 23 via the antenna interface circuit 25. Exemplary implementations of the antenna interface circuit 16/17/25 will be described in more detail hereafter.

Referring again to FIGS. 7-9, the entirety of the radially outer surface 54 of the elongated tubular outer electrical conductor 47 serves as the radio wave radiating surface of the antenna 46 when it is being used as a transmitter, and also serves as the radio wave collection surface of the antenna 46 when it is being used as a receiver—this serves to maximize the total radiating/collection surface area of the antenna 46, which maximizes the performance of the antenna 46 despite its relatively short length L5. The outer conductor's 47 outer surface 54 is of course electrically coupled as a continuous surface to the radially inner surface 55 of the outer conductor 47. The outer conductor's 47 inner surface 55 and the radially outer surface 56 of the elongated tubular inner electrical conductor 48 form an isolation region/zone residing in the axial gap G2, where this isolation region/zone serves to isolate the antenna's radiating/collection surface 54 (and thus the different current paths that exist on, and the radio wave that is being transmitted from or received by, this radiating/collection surface 54) from the various current paths that exist on the axial interior of the outer conductor 47. It is noted that the circuit approximation of the antenna 46 is generally the same as the circuit approximation 44 shown in FIG. 6 and described heretofore.

Referring again to FIGS. 7-9, various different modes of current flow are present in the antenna 46 that affect its operation. As will be appreciated from the more detailed description that follows, these different current flow modes cooperatively contribute to the operation, and the radio wave transmission and reception performance, of the antenna 46. A plurality of different modes of current flow may be present on a single surface of the antenna 46 at the same time. Examples of such current flow modes will now be described in more detail. It is noted that small losses associated with some of the current flows described hereafter are neglected for simplicity sake unless such losses are addressed specifically (e.g., the aforementioned R-RAD). Examples of such neglected small loses include the resistive loss that occurs on the current that flows on the radially inner surface 55 of the elongated tubular outer electrical conductor 47, and the resistive loss that occurs on the current that flows on the radially outer surface 56 of the elongated tubular inner electrical conductor 48.

Referring again to FIGS. 7-9, one mode of current flow that is present in the antenna 46 is that of a conventional coaxial transmission line where the far end (e.g., the opposite end) of the transmission line is shorted. In this particular current flow mode power (e.g., a voltage and a current) that is input to the driven end 49/51 of the antenna 46 flows to the opposite end 50/52 of the antenna 46. Due to the electrical connection (e.g., the short circuit) created by the aforementioned electrical connector and the resulting impedance mismatch that exists at the opposite end 50/52 of the antenna 46, a portion of this input power is reflected at the opposite end 50/52 and flows back to the driven end 49/51 of the antenna 46. The input power and the reflected power pass by each other with no interference between them. In other words, the voltage and current associated with the input power and the voltage and current associated with the reflected power can add or subtract at the instant they pass by each other, but the propagation of the input power is otherwise not affected by the reflected power and vice versa.

Referring again to FIGS. 7-9, due to the electrical connection (e.g., the short circuit) created by the electrical connector at the opposite end 50/52 of the antenna 46 and the fact that the length L5 of the antenna 46 is short or very short with respect to the wavelength(s) of the radio waves that are being transmitted or received by the antenna 46, for low-frequency-type modes of current propagation the radially inner surface 55 of the elongated tubular outer electrical conductor 47 and the elongated tubular inner electrical conductor 48 operate as independent electrical conductors. As such, the following low frequency modes of current flow are also present in the antenna 46. Current flows from the driven end 49 of the outer conductor 47 to the opposite end 50 thereof along the radially inner surface 55 of the outer conductor 47, and current also flows from the driven end 51 of the inner conductor 48 to the opposite end 52 thereof, where some coupling occurs between these two unidirectional low frequency current flows. Current on the radially inner surface 55 of the outer conductor 47 also flows in a direction that is opposite to the direction of low frequency current flow on the inner conductor 48, where some coupling also occurs between these two bidirectional low frequency current flows. The radially inner surface 55 of the outer conductor 47 and the radially outer surface 54 of the outer conductor 47 also operate as independent electrical conductors. As such, another mode of current flow is also present in the antenna 46 where current also flows from the opposite end 50 of the outer conductor 47 to the driven end 49 thereof along the radially outer surface 54 of the outer conductor 47.

Referring again to FIGS. 7-9, the just-described current flows that are present in the antenna 46 result in the radially outer surface 54 of the elongated tubular outer electrical conductor 47 being driven from both its driven end 49 and its opposite end 50. Accordingly, the antenna 46 transmits or receives a radio wave along the entirety of the radially outer surface 54 of the outer conductor 47.

1.3 Short Dual-Driven Groundless Antenna Having Two Inner Conductors

Figure 11:
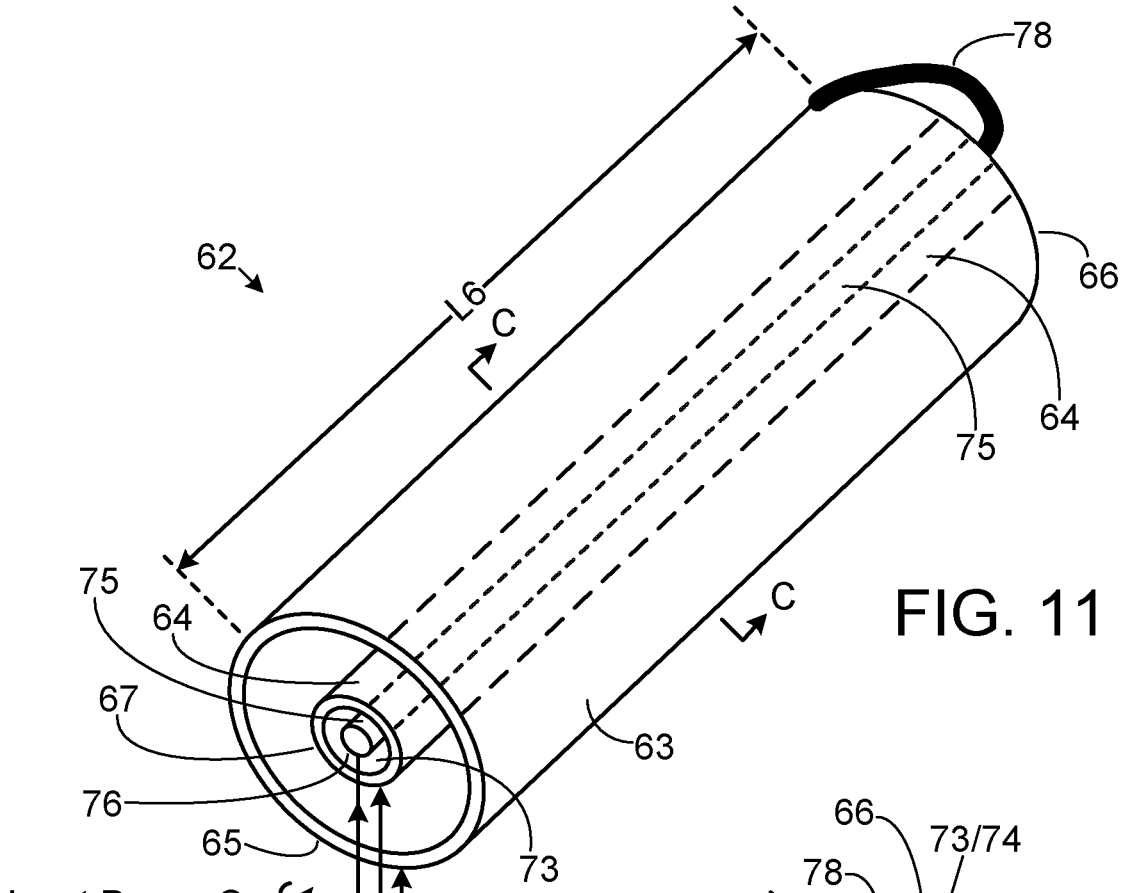
FIG. 11 is a diagram illustrating a longitudinal, partially transparent, plan view, in simplified form, of one implementation of a short dual-driven groundless antenna that includes two inner electrical conductors, where the view shown in FIG. 11 is taken from the perspective of the driven end of the antenna.
Figure 12:
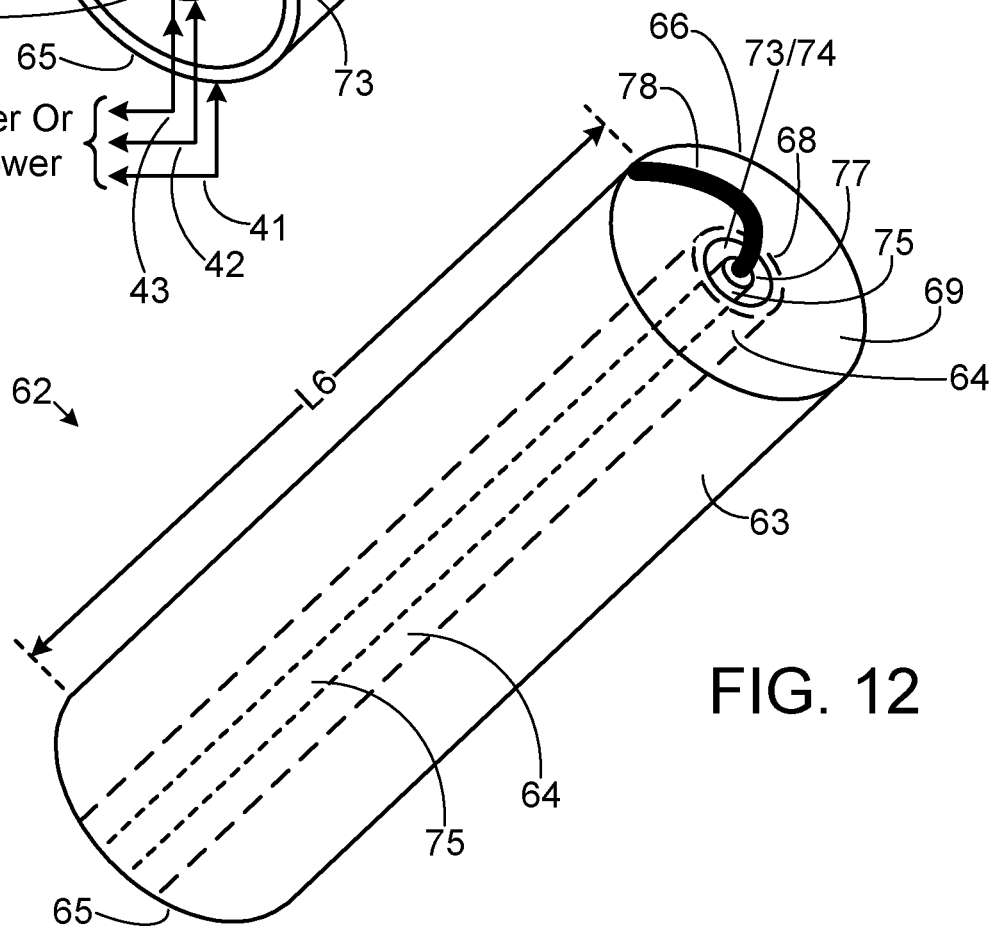
FIG. 12 is a diagram illustrating another longitudinal, partially-transparent, plan view, in simplified form, of the antenna of FIG. 11, where the view shown in FIG. 12 is taken from the perspective of the opposite end of the antenna.
Figure 13:
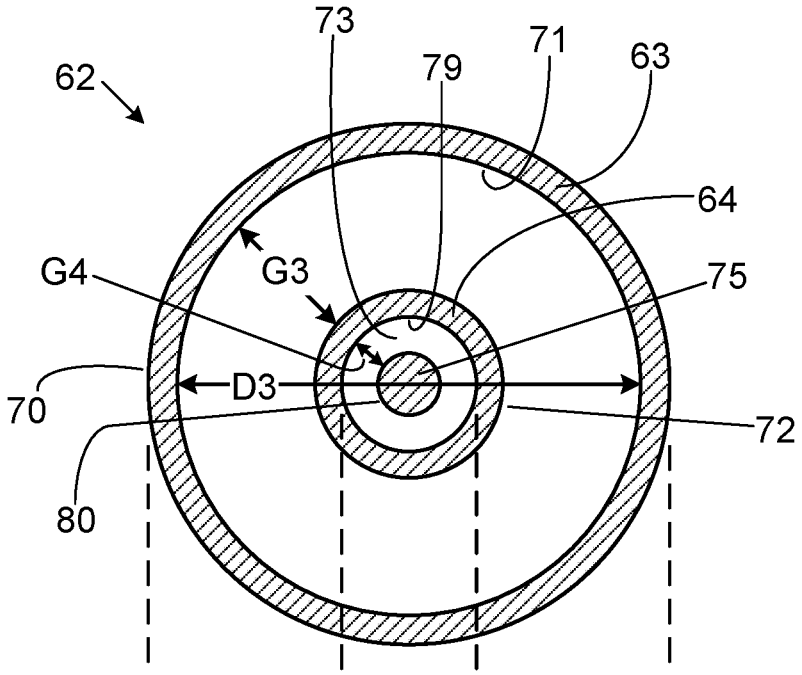
FIG. 13 is a diagram illustrating an enlarged, cross-sectional view, in simplified form, of the antenna of FIGS. 11 and 12 taken along line C-C of FIG. 11.
Figure 14:
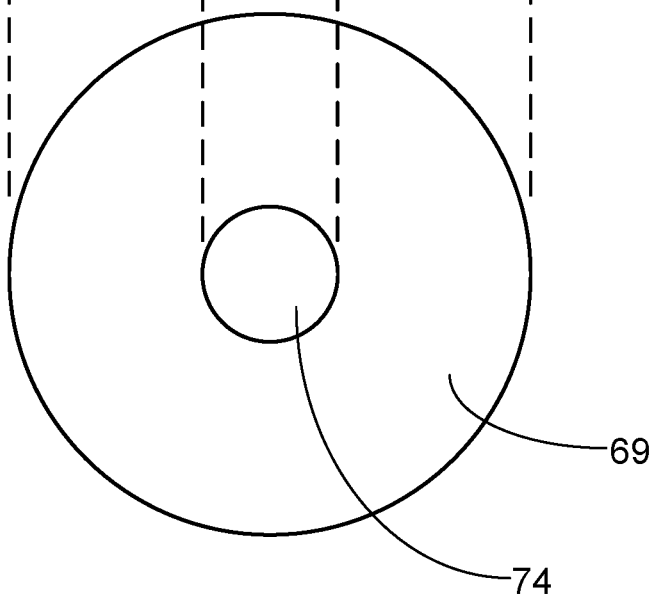
FIG. 14 is a diagram illustrating an enlarged, standalone plan view, in simplified form, of an exemplary implementation of an electrically conductive plate that can be disposed onto the opposite end of the antenna of FIGS. 11 and 12.

FIG. 11 illustrates a longitudinal, partially transparent, plan view, in simplified form, of one implementation of a short dual-driven groundless antenna 62 that includes two inner electrical conductors, namely an elongated tubular inner electrical conductor 64 and an elongated second inner electrical conductor 75, where the view shown in FIG. 11 is taken from the perspective of the driven end 65/67/76 of the antenna 62. FIG. 12 illustrates another longitudinal, partially-transparent, plan view, in simplified form, of the antenna 62 of FIG. 11, where the view shown in FIG. 12 is taken from the perspective of the opposite end 66/68/77 of the antenna 62. FIG. 13 illustrates an enlarged, cross-sectional view, in simplified form, of the antenna 62 of FIGS. 11 and 12 taken along line C-C of FIG. 11. FIG. 14 illustrates an enlarged, standalone plan view, in simplified form, of an exemplary implementation of an electrically conductive plate 69 that can be disposed onto the opposite end 66/68/77 of the antenna 62 of FIGS. 11 and 12. Referring again to FIGS. 3 and 7, and as will be appreciated from the more detailed description that follows, the antenna 62 is more versatile than the antennas 30 and 46 in that the antenna 62 can be "double-tuned."

It is noted that in the antenna 62 implementation exemplified in FIGS. 11-13 the elongated second inner electrical conductor 75 has a solid axial interior. However, an alternate implementation of this antenna (not shown) is possible where the elongated second inner electrical conductor has a hollow axial interior (e.g., this conductor is tubular). It is also noted that different versions of this alternate implementation are also possible where another elongated electrical conductor is longitudinally disposed within the hollow axial interior of the second inner electrical conductor, where this other elongated electrical conductor may have a solid axial interior or a hollow axial interior. In fact, there is no limit to the number of different electrical conductors that may be incorporated into the antenna.

As exemplified in FIGS. 11-14, in addition to the elongated tubular inner electrical conductor 64 and the elongated second inner electrical conductor 75, the antenna 62 also includes an elongated tubular outer electrical conductor 63 having a prescribe length L6, where the hollow axial interior of the tubular outer conductor 63 has a prescribed diameter D3. It will be appreciated that the tubular outer conductor 63 and the tubular inner conductor 64 form one transmission line, and the tubular inner conductor 64 and the second inner conductor 75 form another transmission line. The tubular outer conductor 63 has a driven end 65 and an opposite end 66. The tubular inner conductor 64 also has a driven end 67 and an opposite end 68. The tubular inner conductor 64 has a radially cross-sectional shape and size that allow it to be longitudinally disposed within the hollow axial interior of the tubular outer conductor 63 without coming into contact with the radially inner surface 71 of the tubular outer conductor 63. The second inner conductor 75 also has a driven end 76 and an opposite end 77. The second inner conductor 75 has a radially cross-sectional shape and size that allow it to be longitudinally disposed within the hollow axial interior of the tubular inner conductor 64 without coming into contact with the radially inner surface 79 of the tubular inner conductor 64. The tubular inner conductor 64 is longitudinally disposed within the hollow axial interior of the tubular outer conductor 63 such that an axial gap G3 exists between the radially inner surface 71 of the tubular outer conductor 63 and the radially outer surface 72 of the tubular inner conductor 64. The interior of the tubular outer conductor 63 and the interior 73 of the tubular inner conductor 64 are exposed on the driven ends A/B 65/67 thereof.

Referring again to FIGS. 11-14, the elongated tubular inner electrical conductor 64 generally runs at least to the opposite end 66 of the elongated tubular outer electrical conductor 63. In the particular implementation of the antenna 62 that is shown in FIGS. 11 and 12 the tubular inner conductor 64 has substantially the same length L6 as the tubular outer conductor 63 and the tubular inner conductor 64 runs all the way from the driven end 65 of the tubular outer conductor 63 to the opposite end 66 thereof (e.g., the driven end 65 and driven end 67 are radially substantially aligned with each other, and the opposite end 66 and opposite end 68 are also radially substantially aligned with each other). Alternate implementations of the antenna (not shown) are also possible where the length of the tubular inner conductor is shorter than the length of the tubular outer conductor so that the driven end of the tubular outer conductor extends beyond the driven end of the tubular inner conductor and/or the opposite end of the tubular outer conductor extends beyond the opposite end of the tubular inner conductor. The second inner conductor 75 is longitudinally disposed within the hollow axial interior of the tubular inner conductor 64 such that an axial gap G4 exists between the radially inner surface 79 of the tubular inner conductor 64 and the radially outer surface 80 of the second inner conductor 75. In the particular implementation of the antenna 62 that is shown in FIGS. 11 and 12 the second inner conductor 75 has substantially the same length as the tubular inner conductor 64 and the second inner conductor 75 runs from the driven end 67 of the tubular inner conductor 64 to the opposite end 68 thereof. Alternate implementations of the antenna (not shown) are also possible where the length of the second inner conductor is shorter than the length of the tubular inner conductor so that the driven end of the tubular inner conductor extends beyond the driven end of the second inner conductor and/or the opposite end of the tubular inner conductor extends beyond the opposite end of the second inner conductor. As will be described in more detail hereafter, a first electrical signal 41 is electrically connected to the driven end 65 of the tubular outer conductor 63, a second electrical signal 42 is electrically connected to the driven end 67 of the tubular inner conductor 64, and a third electrical signal 43 is electrically connected to the driven end 76 of the second inner conductor 75, where the first, second and third electrical signals 41-43 supply input power to the antenna 62 whenever it is used as a transmitter, these signals 41-43 supply output power from the antenna 62 whenever it is used as a receiver, and none of these signals 41-43 is grounded.

Referring again to FIGS. 11-14, the antenna 62 also includes an electrical connector that electrically connects the opposite end 66 of the elongated tubular outer electrical conductor 63 to the exterior of the elongated tubular inner electrical conductor 64. In the version of the antenna 62 that is shown in FIGS. 11, 12 and 14 this electrical connector is realized as an electrically conductive plate 69 that is disposed onto the opposite end 66 of the tubular outer conductor 63 as follows. The conductive plate 69 is electrically connected to the circumference or a part thereof of the opposite end 66 of the tubular outer conductor 63, and can also be electrically connected to the exterior of the tubular inner conductor 64 in various ways. By way of example but not limitation, in the particular implementation of the antenna 62 that is shown in FIGS. 11, 12 and 14 where the opposite ends 66/68 of the tubular outer and inner conductors 63/64 are radially substantially aligned with each other, the plate 69 can be electrically connected to the circumference or a part thereof of the opposite end 68 of the tubular inner conductor 64. In an alternate implementation of the antenna (not shown) where the opposite end of the tubular inner conductor extends beyond the opposite end of the tubular outer conductor, the plate can be electrically connected to the circumference or a part thereof of the radially outer surface of the tubular inner conductor. As such, the conductive plate 69 serves to electrically short the exterior of the tubular inner conductor 64 at or near the opposite end 68 thereof to the opposite end 66 of the tubular outer conductor 63, and also serves to close the axial gap G3 on this opposite end 66. However, the conductive plate 69 includes an aperture 74 having a shape, a size, and a position on the plate 69 that generally allows the hollow axial interior 73 of the tubular inner conductor 64 to pass through the plate 69. More particularly, in the version of the plate 69 that is shown in FIGS. 12 and 14, the aperture 74 has a shape and size that are substantially the same as the radially cross-sectional shape and size of the interior 73 of the tubular inner conductor 64, and the aperture 74 is substantially centered over this interior 73. An alternate version of the plate (not shown) is also possible where the aperture has a shape and size that are substantially the same as the radially cross-sectional shape and size of the outer surface of the tubular inner conductor, and the aperture is substantially centered over this outer surface, thus allowing the tubular inner conductor to pass through the plate. An alternate version of the antenna (not shown) is also possible where the aforementioned electrical connector is realized as an inductor having a low value, or a capacitor.

Referring again to FIGS. 11-13, the opposite end 77 of the elongated second inner electrical conductor 75 is electrically connected 78 to the opposite end 66 of the elongated tubular outer electrical conductor 63. In the particular implementation of the antenna 62 that is shown in FIGS. 11 and 12 this electrical connection 78 is a wire that creates a short circuit between the opposite end 77 of the second inner conductor 75 and the opposite end 66 of the tubular outer conductor 63. Alternate implementations of the antenna (not shown) are also possible where the electrical connection between the opposite ends of the second inner conductor and the tubular outer conductor is made in other ways. By way of example but not limitation, this electrical connection may include a series-connected capacitor or a series-connected inductor.

Referring again to FIGS. 11-13, the elongated tubular inner electrical conductor 64 can be longitudinally disposed within the hollow axial interior of the elongated tubular outer electrical conductor 63 in various ways. By way of example but not limitation, in the version of the antenna 62 that is shown in FIGS. 11-13 the tubular inner conductor 64 runs along the longitudinal axis of the tubular outer conductor 63 (e.g., the tubular inner conductor 64 and the tubular outer conductor 63 are substantially concentric/coaxial). In another version of the antenna (not shown) the tubular inner conductor runs along an axis that is substantially parallel to the longitudinal axis of the tubular outer conductor (e.g., the longitudinal axis of the tubular inner conductor is offset a prescribed distance from the longitudinal axis of the tubular outer conductor so that the tubular inner conductor is not centered within the tubular outer conductor but rather runs closer to one side of the tubular outer conductor's radially inner surface than the other sides thereof). The aforementioned axial gap G3 that exists between the radially inner surface 71 of the tubular outer conductor 63 and the radially outer surface 72 of the tubular inner conductor 64 can be filled with a dielectric material. In a tested version of the antenna 62 the dielectric material that filled the gap G3 was air. Other versions of the antenna 62 are also possible where various other dielectric materials can be used to fill the gap G3 such as nylon, a polycarbonate, or the like. Yet another version of the antenna 62 is also possible where a dielectric coating (not shown) is applied to the radially inner surface 71 of the tubular outer conductor 63 and the radially outer surface 72 of the tubular inner conductor 64, and the gap G3 is filled with a ferrite material which serves to change the impedance of the antenna 62.

Referring again to FIGS. 11-13, the elongated second inner electrical conductor 75 can be longitudinally disposed within the hollow axial interior of the elongated tubular inner electrical conductor 64 in various ways. By way of example but not limitation, in the version of the antenna 62 that is shown in FIGS. 11-13, the second inner conductor 75 runs along the longitudinal axis of the tubular inner conductor 64 (e.g., the second inner conductor 75 and the tubular inner conductor 64 are substantially concentric/coaxial). In another version of the antenna (not shown) the second inner conductor runs along an axis that is substantially parallel to the longitudinal axis of the tubular inner conductor (e.g., the longitudinal axis of the second inner conductor is offset a prescribed distance from the longitudinal axis of the tubular inner conductor so that the second inner conductor is not centered within the tubular inner conductor but rather runs closer to one side of the tubular inner conductor's radially inner surface than the other sides thereof). The aforementioned axial gap G4 that exists between the radially inner surface 79 of the tubular inner conductor 64 and the radially outer surface 80 of the second inner conductor 75 can be filled with a dielectric material. In a tested version of the antenna 62 the dielectric material that filled the gap G4 was air. Other versions of the antenna 62 are also possible where various other dielectric materials can be used to fill the gap G4 such as nylon, a polycarbonate, or the like.

Referring again to FIGS. 11-13, the elongated second inner electrical conductor 75, the elongated tubular inner electrical conductor 64, the elongated tubular outer electrical conductor 63, and the electrically conductive plate 69 can be constructed from any material which is durable and electrically conductive. By way of example but not limitation, in a tested version of the antenna 62 the inner conductors 75/64, the tubular outer conductor 63, and the plate 69 were constructed from copper. Other versions of the antenna 62 are also possible where the inner conductors 75/64, the tubular outer conductor 63, and the plate 69 are constructed from one of a variety of other metals (e.g., aluminum, stainless steel, brass, nickel alloys, gold, platinum, silver, or the like) or another type of durable, electrically conductive material. Yet other versions of the antenna 62 are possible where the inner conductors 75/64, the tubular outer conductor 63, and the plate 69 are constructed from different durable and electrically conductive materials. Another version of the antenna 62 is possible where the inner conductors 75/64 and the tubular outer conductor 63 are constructed in a manner that results in the antenna 62 being flexible along its longitudinal axis. For example, the inner conductors 75/64 and the tubular outer conductor 63 may be part of a conventional flexible coaxial cable. Advantages of this flexible implementation have been described heretofore.

Referring again to FIGS. 11-13, it will be appreciated that various trade-offs exist in selecting the type(s) of material(s) to be used for the elongated second inner electrical conductor 75, the elongated tubular inner electrical conductor 64, the elongated tubular outer electrical conductor 63, and the electrically conductive plate 69. Examples of such trade-offs include cost, weight, and the manner in which electrical connections are made to the material(s). In the aforementioned case where the axial gap G3 is filled with air, depending on the length L6 of the tubular outer conductor 63 and the type(s) of material(s) that the tubular outer conductor 63 and tubular inner conductor 64 are constructed from, one or more electrically non-conductive spacer elements (not shown) may be interposed in the gap G3 and spaced along the longitudinal axis of the tubular outer conductor 63, where each of these spacer elements serves to structurally hold the tubular inner conductor 64 in place and keep it from coming in contact with the radially inner surface 71 of the tubular outer conductor 63. Similarly, in the aforementioned case where the axial gap G4 is filled with air, depending on the length of the tubular inner conductor 64 and the type(s) of material(s) that the tubular inner conductor 64 and the second inner conductor 75 are constructed from, one or more additional electrically non-conductive spacer elements (not shown) may be interposed in the gap G4 and spaced along the longitudinal axis of the tubular inner conductor 64, where each of these additional spacer elements serves to structurally hold the second inner conductor 75 in place and keep it from coming in contact with the radially inner surface 79 of the tubular inner conductor 64. By way of example but not limitation, in the tested version of the antenna 62 where the inner conductors 75/64 and the tubular outer conductor 63 were constructed from copper, plastic washers were employed for the spacer elements.

Referring again to FIGS. 1, 2 and 11, in the case where the antenna 62 is being used as a radio wave transmitter the input power supplied by the transmission electronics 13 is electrically input to the antenna 62 at three different points, namely the driven end 65 of the elongated tubular outer electrical conductor 63, the driven end 67 of the elongated tubular inner electrical conductor 64, and the driven end 76 of the elongated second inner electrical conductor 75. More particularly and as described heretofore, this input power may be supplied to the antenna 62 directly from the power coupling cable 14, or this input power may be supplied to the antenna 62 via the antenna interface circuit 16/17. Similarly, in the case where the antenna 62 is being used as a radio wave receiver the output power supplied by the antenna 62 is electrically output from the antenna 62 at the just-described three different points. More particularly and as also described heretofore, this output power may be supplied to the power coupling cable 23 directly from the antenna 62, or this output power may be supplied to the power coupling cable 23 via the antenna interface circuit 25. Exemplary implementations of the antenna interface circuit 16/17/25 will be described in more detail hereafter.

Referring again to FIGS. 11-13, the entirety of the radially outer surface 70 of the elongated tubular outer electrical conductor 63 serves as the radio wave radiating surface of the antenna 62 when it is being used as a transmitter, and also serves as the radio wave collection surface of the antenna 62 when it is being used as a receiver—this serves to maximize the total radiating/collection surface area of the antenna 62, which maximizes the performance of the antenna 62 despite its relatively short length L6. The tubular outer conductor's 63 outer surface 70 is of course electrically coupled as a continuous surface to the radially inner surface 71 of the tubular outer conductor 63. The tubular outer conductor's 63 inner surface 71 and the radially outer surface 72 of the elongated tubular inner electrical conductor 64 form an isolation region/zone residing in the axial gap G3, where this isolation region/zone serves to isolate the antenna's radiating/collection surface 70 (and thus the different current paths that exist on, and the radio wave that is being transmitted from or received by, this radiating/collection surface 70) from the various current paths that exist on the axial interior of the tubular outer conductor 63. The radially inner surface 79 of the tubular inner conductor 64 and the radially outer surface 80 of the elongated second inner electrical conductor 75 form another isolation region/zone residing in the axial gap G4, where this other isolation region/zone serves to isolate the outer surface 72 of the tubular inner conductor 64 from the various current paths that exist on the axial interior 73 of the tubular inner conductor 64. It is noted that the circuit approximation of the antenna 62 is generally the same as the circuit approximation 44 shown in FIG. 6 and described heretofore.

Referring again to FIGS. 11-13, various different modes of current flow are present in the antenna 62 that affect its operation. As will be appreciated from the more detailed description that follows, these different current flow modes cooperatively contribute to the operation, and the radio wave transmission and reception performance, of the antenna 62. A plurality of different modes of current flow may be present on a single surface of the antenna 62 at the same time. Examples of such current flow modes will now be described in more detail. It is noted that small losses associated with some of the current flows described hereafter are neglected for simplicity sake unless such losses are addressed specifically (e.g., the aforementioned R-RAD). Examples of such neglected small loses include the resistive loss that occurs on the current that flows on the radially inner surface 71 of the elongated tubular outer electrical conductor 63, and the resistive loss that occurs on the current that flows on the radially outer surface 72 of the elongated tubular inner electrical conductor 64.

Referring again to FIGS. 11-13, one mode of current flow that is present in the antenna 62 is that of a conventional coaxial transmission line where the far end (e.g., the opposite end) of the transmission line is shorted. In this particular current flow mode power (e.g., a voltage and a current) that is input to the driven end 65/67/76 of the antenna 62 flows to the opposite end 66/68/77 of the antenna 62. Due to the electrical connection (e.g., the short circuit) created by the aforementioned electrical connector and the resulting impedance mismatch that exists at the opposite end 66/68/77 of the antenna 62, a portion of this input power is reflected at the opposite end 66/68/77 and flows back to the driven end 65/67/76 of the antenna 62. The input power and the reflected power pass by each other with no interference between them. In other words, the voltage and current associated with the input power and the voltage and current associated with the reflected power can add or subtract at the instant they pass by each other, but the propagation of the input power is otherwise not affected by the reflected power and vice versa.

Referring again to FIGS. 11-13, due to the electrical connection (e.g., the short circuit) created by the electrical connector at the opposite end 66/68/77 of the antenna 62 and the fact that the length L6 of the antenna 62 is short or very short with respect to the wavelength(s) of the radio waves that are being transmitted or received by the antenna 62, for low-frequency-type modes of current propagation the radially inner surface 71 of the elongated tubular outer electrical conductor 63 and the elongated tubular inner electrical conductor 64 operate as independent electrical conductors. As such, the following low frequency modes of current flow are also present in the antenna 62. Current flows from the driven end 65 of the tubular outer conductor 63 to the opposite end 66 thereof along the radially inner surface 71 of the tubular outer conductor 63, and current also flows from the driven end 67 of the tubular inner conductor 64 to the opposite end 68 thereof, where some coupling occurs between these two unidirectional low frequency current flows. Current on the radially inner surface 71 of the tubular outer conductor 63 also flows in a direction that is opposite to the direction of low frequency current flow on the tubular inner conductor 64, where some coupling also occurs between these two bidirectional low frequency current flows. The radially inner surface 71 of the tubular outer conductor 63 and the radially outer surface 70 of the tubular outer conductor 63 also operate as independent electrical conductors. As such, another mode of current flow is also present in the antenna 62 where current also flows from the opposite end 66 of the tubular outer conductor 63 to the driven end 65 thereof along the radially outer surface 70 of the tubular outer conductor 63.

Referring again to FIGS. 11-13, the just-described current flows that are present in the antenna 62 result in the radially outer surface 70 of the elongated tubular outer electrical conductor 63 being driven from both its driven end 65 and its opposite end 66. Accordingly, the antenna 62 transmits or receives a radio wave along the entirety of the radially outer surface 70 of the tubular outer conductor 63.

In the antenna 62 implementation exemplified in FIGS. 11 and 12 the elongated tubular outer electrical conductor 63, the elongated tubular inner electrical conductor 64, and the elongated second inner electrical conductor 75 each have substantially the same length L6, the driven end 65 and driven end 67 and driven end 76 are radially substantially aligned with each other, and the opposite end 66 and opposite end 68 and opposite end 77 are also radially substantially aligned with each other). However, alternate implementations of this antenna (not shown) are also possible where the tubular inner conductor and the second inner conductor have a length that is different than the length of the tubular outer conductor. By way of example but not limitation, the tubular inner conductor and the second inner conductor may be longer than the tubular outer conductor so that the opposite ends of the tubular inner conductor and the second inner conductor run past and thus extend beyond the opposite end of the tubular outer conductor. In this particular implementation there would be two different radio wave radiating/collection surfaces, the first radiating/collection surface being the radially outer surface of the tubular outer conductor, and the second radiating/collection surface being the radially outer surface of the portion of the tubular inner conductor that extends beyond the opposite end of the tubular outer conductor. This particular implementation advantageously saves material, and thus cost and weight, since the radially outer surface of the tubular outer conductor and the radially outer surface of the portion of the tubular inner conductor that extends beyond the opposite end of the tubular outer conductor effectively operate as a common radiating surface when the antenna is used as a transmitter, and a common collection surface when the antenna is used as a receiver. The tubular inner conductor and the second inner conductor may also be shorter than the tubular outer conductor so that the driven end of the tubular outer conductor extends beyond the driven ends of the tubular inner conductor and the second inner conductor. In this particular implementation the radially inner surface of the tubular outer conductor would carry the current to the opposite end of the tubular outer conductor.

1.4 Antenna Interface Circuits

Referring again to FIGS. 1 and 2, this section provides a more detailed description of exemplary implementations of the antenna interface circuits 16/17/25 that can be used to couple the input power supplied by the power coupling cable 14 to a given antenna 18/19 that is being used to transmit a radio wave 11/12 into free space, and can also be used to couple the output power supplied by a given antenna 26 to the power coupling cable 23 when the antenna 26 is being used to receive a radio wave 21. In addition to performing the just-described power coupling and as described heretofore, in the radio wave transmission application the antenna interface circuit 16/17 can be used to modify the input impedance of the antenna 18/19 in order to help match this input impedance to the impedance of the power coupling cable 14, and the interface circuit 16/17 can also be used to tune the transmission characteristics (e.g., the desired frequency band to be transmitted and the phase thereof) of the antenna 18/19. In the radio wave reception application the antenna interface circuit 25 can be used to modify the output impedance of the antenna 26 in order to help match this output impedance to the impedance of the power coupling cable 23, and the interface circuit 25 can also be used to tune the reception characteristics (e.g., the desired frequency band to be received and the phase thereof) of the antenna 26.

Figure 15:
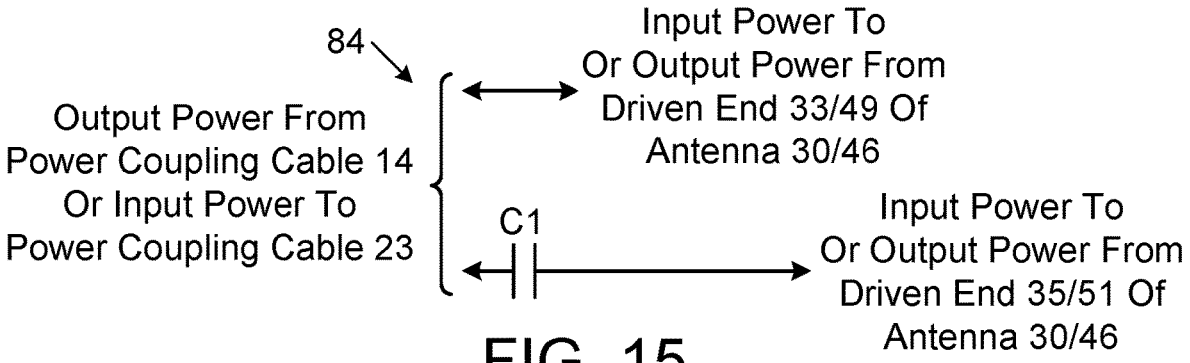
FIGS. 15-17 are schematic diagrams illustrating various exemplary implementations, in simplified form, of an antenna interface circuit that can be used to couple input power to or output power from the driven end of the antenna of FIGS. 3 and 4, and the antenna of FIGS. 7 and 8.
Figure 16:
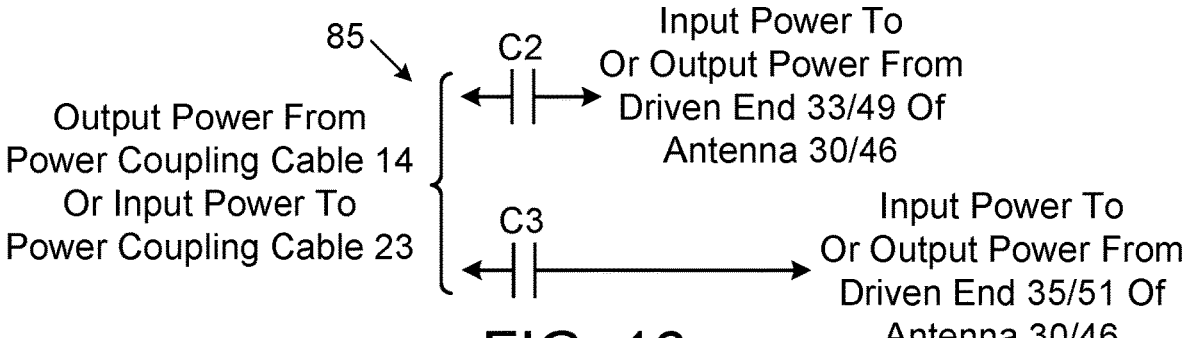
Figure 17:
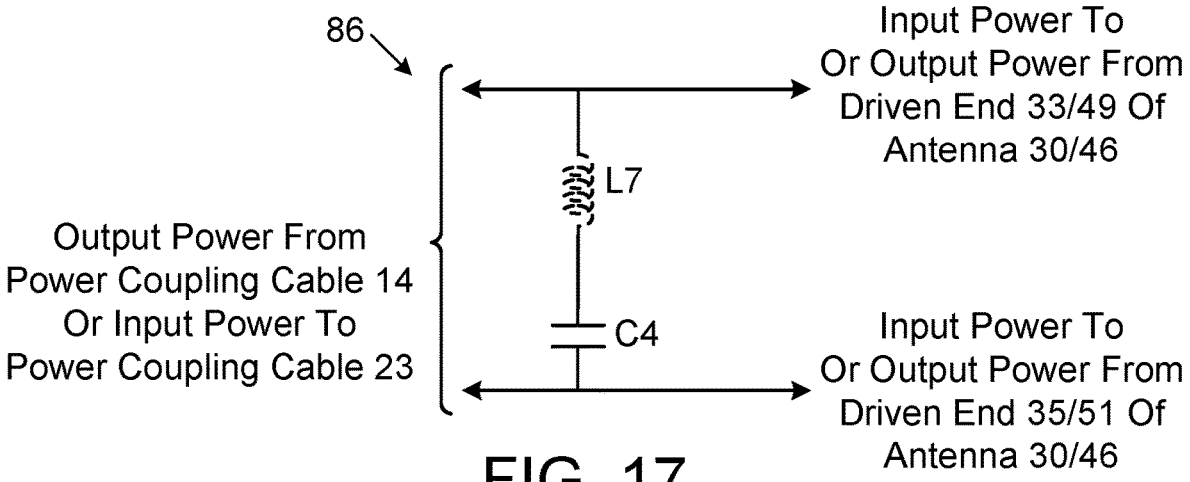

FIGS. 15-17 illustrate various exemplary implementations, in simplified form, of an antenna interface circuit 84-86 that can be used to couple input power to or output power from the driven end 33/35 of the antenna 30 of FIGS. 3 and 4, and the driven end 49/51 of the antenna 46 of FIGS. 7 and 8. It is noted that in addition to the antenna interface circuits 84-86 shown in FIGS. 15-17, many other antenna interface circuit designs (not shown) are also possible. For example, various combinations of the circuits 84-86, or other conventional circuit designs, may also be used to perform the aforementioned impedance matching, frequency band tuning, and phase tuning.

Referring again to FIGS. 3-5, 7-9, the antenna interface circuit 84 exemplified in FIG. 15 includes a capacitor C1 that is electrically connected in series to the driven end 35 of the elongated inner electrical conductor 32 of the antenna 30, or to the driven end 51 of the elongated tubular inner electrical conductor 48 of the antenna 46. As previously described in section 1.1, the just-described capacitor C1 can also be moved to the opposite end 34/36 of the antenna 30 in which case C1 would be part of the electrical connection 37. The antenna interface circuit 85 exemplified in FIG. 16 includes a capacitor C2 that is electrically connected in series to the driven end 33 of the elongated tubular electrical conductor 31 of the antenna 30, or to the driven end 49 of the elongated tubular outer electrical conductor 47 of the antenna 46. This interface circuit 85 also includes a capacitor C3 that is electrically connected in series to the driven end 35 of the inner conductor 32 of the antenna 30, or to the driven end 51 of the inner conductor 48 of the antenna 46. With respect to the antenna 30, the interface circuits 84/85 can be used to optimize the isolation of the antenna's 30 radiating/collection surface 38 from the different current paths that exist on the inside of the tubular conductor 31 by tuning the aforementioned isolation region/zone residing in the axial gap G1 as an open circuit. Similarly, with respect to the antenna 46, the interface circuits 84/85 can be used to optimize the isolation of the antenna's 46 radiating/collection surface 54 from the different current paths that exist on the inside of the outer conductor 47 by tuning the aforementioned isolation region/zone residing in the axial gap G2 as an open circuit. The value of the capacitors C1/C2/C3 can be selected to tune for the desired frequency to be transmitted/received by the antenna 30/46. The length of the conductors 31/32/47/48 combined with their relative diameters can be selected to tune the isolation region/zone to have a desired inductance that makes an impedance match to the output/input of the power coupling cable 14/23 at this desired frequency. In other words, a given antenna 30/46 can be tuned from one frequency band to another by changing the value of capacitor C1/C2/C3 and then re-tuning the impedance match as necessary, where this impedance match re-tuning can be accomplished using the capacitor C4 or optional inductor L7 described hereafter. Furthermore, it is noted that the impedance of the isolation region/zone of the antennas 30/46 is not linear with frequency. As such, if the impedance match re-tuning needs added series inductance this can be easily and cost-effectively accomplished with short pieces of wire acting as small series inductors.

Referring again to FIGS. 3, 5, 7 and 9, the antenna interface circuit 86 exemplified in FIG. 17 includes a capacitor C4 that is electrically connected between the driven ends 33/35 of the elongated tubular electrical conductor 31 and elongated inner electrical conductor 32 of the antenna 30, or between the driven ends 49/51 of the elongated tubular outer electrical conductor 47 and elongated tubular inner electrical conductor 48 of the antenna 46. In other words, the capacitor C4 is electrically connected across the driven end of the isolation region/zone of the antenna 30/46. The circuit 86 can optionally include an inductor L7 that is electrically connected in series with the capacitor C4, where the inductor L7 may be used to fine tune the impedance match provided by the circuit 86.

Figure 18:
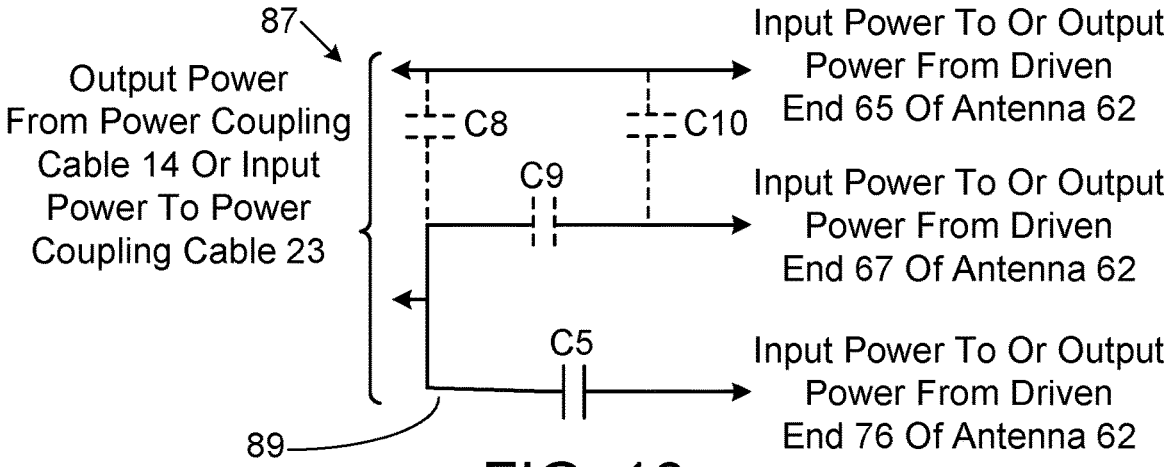
FIGS. 18 and 19 are schematic diagrams illustrating various exemplary implementations, in simplified form, of an antenna interface circuit that can be used to couple input power to or output power from the driven end of the antenna of FIGS. 11 and 12.
Figure 19:
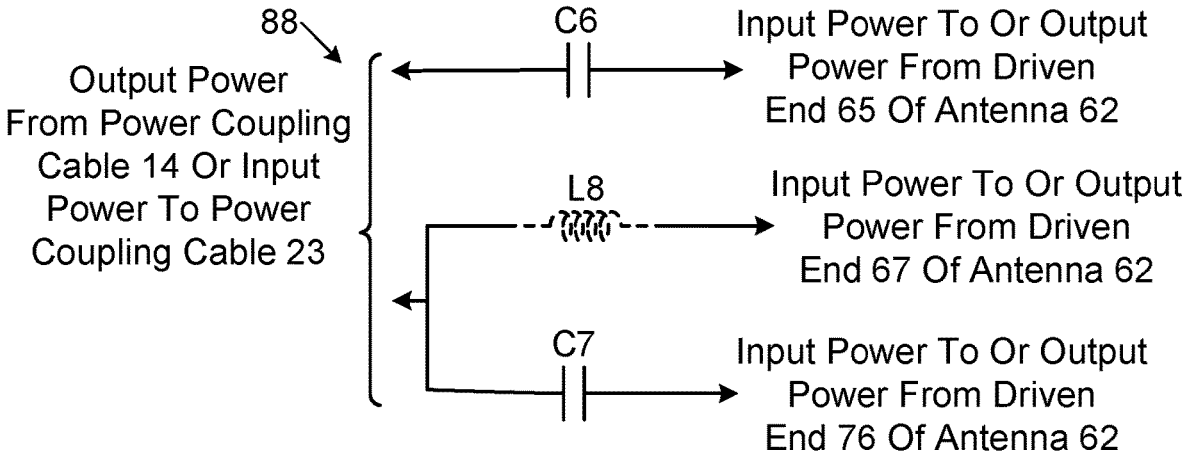

FIGS. 18 and 19 illustrate various exemplary implementations, in simplified form, of an antenna interface circuit 87/88 that can be used to couple input power to or output power from the driven end 65/67/76 of the antenna 62 of FIGS. 11 and 12. It is noted that in addition to the antenna interface circuits 87/88 shown in FIGS. 18 and 19, many other antenna interface circuit designs (not shown) are also possible. For example, various combinations of the circuits 87/88, or other conventional circuit designs, may also be used to perform the aforementioned impedance matching, frequency band tuning, and phase tuning.

Referring again to FIGS. 11-13, the antenna interface circuit 87 exemplified in FIG. 18 includes a capacitor C5 that is electrically connected in series to the driven end 76 of the elongated second inner electrical conductor 75 of the antenna 62. The circuit 87 can optionally include a capacitor C9 that is electrically connected in series to the driven end 67 of the elongated tubular inner electrical conductor 64 of the antenna 62, where the capacitor C9 may be used to fine tune the impedance match provided by the circuit 87. The circuit 87 can optionally also include a capacitor C8 one end of which is electrically connected to the driven end 65 of the elongated tubular outer electrical conductor 63 of the antenna 62, and the other end of which is electrically connected to the driven end 89 of capacitor C5, where the capacitor C8 may also be used to fine tune the impedance match provided by the circuit 87. The circuit 87 can optionally also include a capacitor C10 that is electrically connected between the driven ends 65/67 of the elongated tubular outer electrical conductor 63 and the tubular inner conductor 64 of the antenna 62, where the capacitor C10 may also be used to fine tune the impedance match provided by the circuit 87. As previously described in section 1.3, the just-described capacitor C5 can also be moved to the opposite end 66/77 of the antenna 62 in which case C5 would be part of the electrical connection 78. The antenna interface circuit 88 exemplified in FIG. 19 includes a capacitor C6 that is electrically connected in series to the driven end 65 of the tubular outer conductor 63 of the antenna 62, and also includes a capacitor C7 that is electrically connected in series to the driven end 76 of the second inner conductor 75 of the antenna 62. The circuit 88 can optionally also include an inductor L8 that has a low value and is electrically connected in series to the driven end 67 of the tubular inner conductor 64, where the inductor L8 may be used to fine tune the impedance match provided by the circuit 88. An alternate implementation of the interface circuit 88 is also possible where another capacitor (not shown) is electrically connected in series to the driven end 67 of the tubular inner conductor 64 of the antenna 62. The interface circuits 87/88 can be used to optimize the isolation of the antenna's 62 radiating/collection surface 70 from the different current paths that exist on the inside of the tubular conductor 63 by tuning the aforementioned isolation region/zone residing in the axial gap G3 as an open circuit. The value of the capacitors C5/C6/C7/C8/C9/C10 and inductor L8 can be selected to tune for the desired frequency to be transmitted/received by the antenna 62. The length of the conductors 63/64/75 combined with their relative diameters can be selected to tune the isolation region/zone to have a desired inductance that makes an impedance match to the output/input of the power coupling cable 14/23 at this desired frequency. In other words, a given antenna 62 can be tuned from one frequency band to another by changing the value of capacitor C5/C6/C7 and then re-tuning the impedance match as necessary, where this impedance match re-tuning can be accomplished using the capacitors C8/C9/C10. Furthermore, it is noted that the impedance of the isolation region/zone of the antenna 62 is not linear with frequency. As such, if the impedance match re-tuning needs added series inductance this can be easily and cost-effectively accomplished with short pieces of wire acting as small inductors.

Referring again to FIGS. 11-13, 18 and 19, it is noted that the existence of a capacitor electrically connected in series to the driven end 76 of the elongated second inner electrical conductor 75 of the antenna 62 (e.g. capacitor C5/C7) results in the second inner conductor 75 and the elongated tubular inner electrical conductor 64 being driven with different signals which causes a parallel driving voltage to appear between the second inner conductor 75 and the radially inner surface 79 of the tubular inner conductor 64. The existence of this parallel driving voltage significantly lowers the voltage appearing across the just-described series connected capacitor or inductor, which has both safety and cost advantages.

Referring again to FIGS. 11, 13 and 18, it is noted that the antenna interface circuit 87 can also be used to double-tune the antenna 62. More particularly the addition of capacitor C8 or C10 to the interface circuit 87 can make the transmission line that is formed by the elongated tubular outer electrical conductor 63 and the elongated tubular inner electrical conductor 64 of the antenna 62 act as an open circuit that passes a selected tuned frequency which may be controlled by the capacitor C5 or C9. The value of capacitors C5 and C9 may also be chosen to create a second tuned circuit that passes another selected tuned frequency which may provide the antenna 62 with a broader band response, or a two-peaked response, if desired.

2.0 Other Implementations

While the antennas have been described by specific reference to implementations thereof, it is understood that variations and modifications thereof can be made without departing from the true spirit and scope of the antennas. By way of example but not limitation, rather than the antenna implementations having a length that is short or very short with respect to the wavelength(s) of the radio waves that are being transmitted or received by the antenna implementations, the antenna implementations can also have a length that is longer than the wavelength(s) of the radio waves that are being transmitted or received. Furthermore, in each of the antenna implementations described heretofore each of the conductors has a radially cross-sectional shape that is circular. However, alternate implementations of the antenna described herein are also possible where each of the conductors has any other radially cross-sectional shape. Thus, each of the conductors can have a radially cross-sectional shape that is oval, triangular, square, rectangular, pentagonal, hexagonal, or octagonal, among others. Furthermore, in each of the antenna implementations described heretofore each of the conductors has substantially the same radially cross-sectional shape. However, alternate implementations of the antenna described herein are also possible where one or more of the conductors in a given antenna has a radially cross-sectional shape that is different than the radially cross-sectional shape of one or more other conductors in the antenna.

Figure 20:
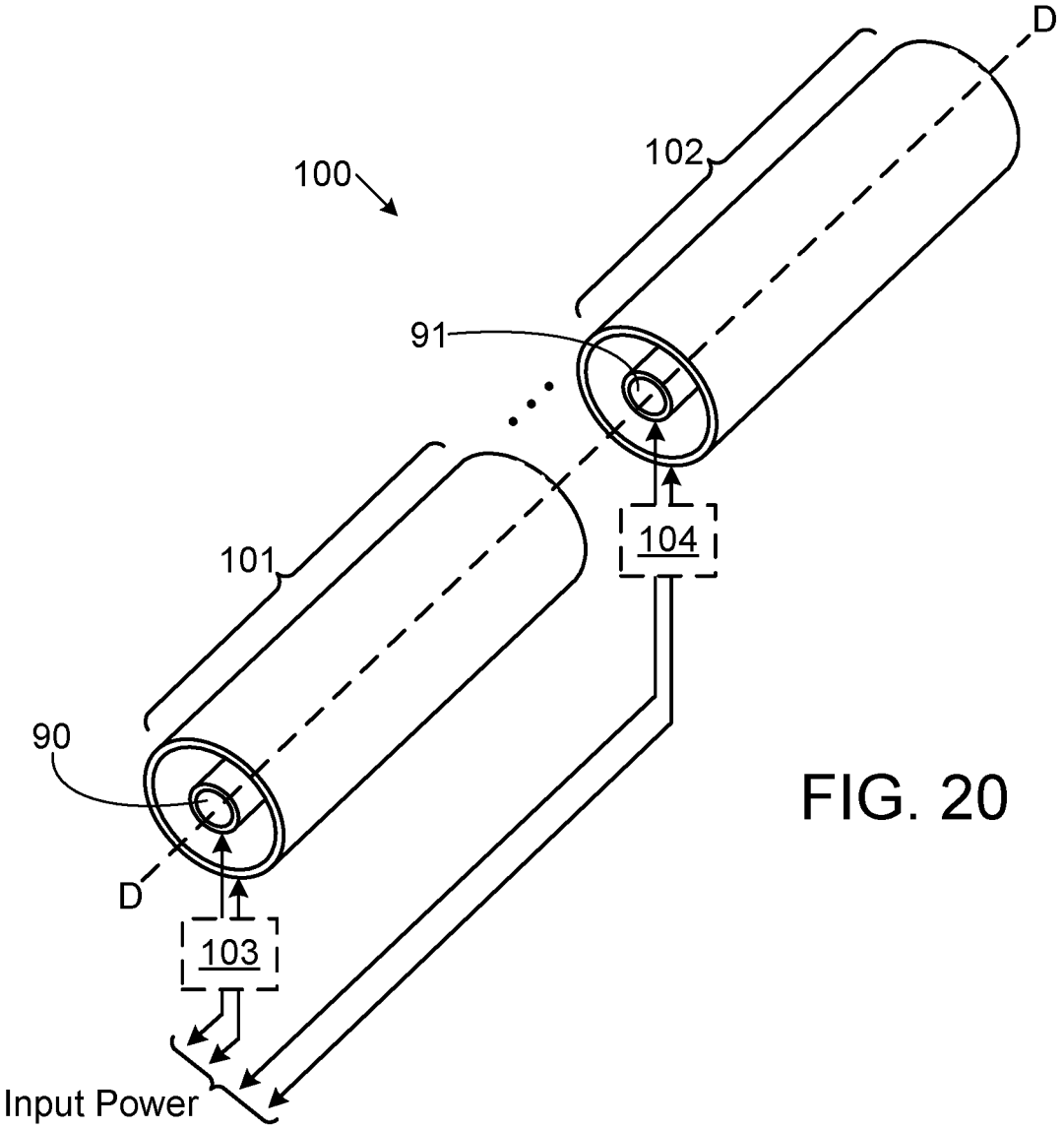
FIG. 20 is a diagram illustrating a longitudinal plan view, in simplified form, of an exemplary implementation of a short dual-driven groundless combination antenna, where the view shown in FIG. 20 is taken from the perspective of the driven end of the combination antenna.

It is noted that any or all of the antenna implementations that are described in the present document and any or all of the antenna implementations that are illustrated in the accompanying drawings may be used and thus claimed in any combination desired to form additional hybrid antenna implementations. By way of example but not limitation, FIG. 20 illustrates a longitudinal plan view, in simplified form, of an exemplary implementation of a short dual-driven groundless combination antenna 100 for transmitting radio waves, where the view shown in FIG. 20 is taken from the perspective of the driven end of the combination antenna 100. As exemplified in FIG. 20, the combination antenna 100 includes two or more individual short dual-driven groundless elongated antennas 101/102 that are disposed end-to-end along a common longitudinal axis D-D (e.g., end-to-end in a line) and function together as a single antenna. In the particular implementation of the combination antenna 100 that is shown in FIG. 20 each of the individual antennas 101/102 is the antenna 46 shown in FIG. 7. However, it is noted that various alternate implementations (not shown) of the combination antenna are also possible. For example, each of the individual antennas may be the antenna 30 shown in FIG. 3, or may be the antenna 62 shown in FIG. 11. The combination antenna may also be made up of any combination of the antenna 30, the antenna 46, the antenna 62, and/or any of the other antenna implementations described herein. As also exemplified in FIG. 20, each of the individual antennas 101/102 includes an elongated tubular electrical conductor having a driven end and an opposite end. Each of the antennas 101/102 also includes an elongated inner electrical conductor having a driven end, an opposite end, and a radially cross-sectional shape and size that allow the inner electrical conductor to be longitudinally disposed within the hollow axial interior of the tubular electrical conductor without coming into contact with the radially inner surface thereof. For each of the antennas 101/102, its inner electrical conductor is longitudinally disposed within the interior of its tubular electrical conductor such that an axial gap exists between the inner surface of its tubular electrical conductor and a radially outer surface of its inner electrical conductor, and the opposite end of its inner electrical conductor is electrically connected to the opposite end of its tubular electrical conductor. It is noted that rather than the wires which carry the electrical signals that supply input power to or output power from the driven ends of the antennas 101/102 being run on the outside of the antennas 101/102 as shown in FIG. 20, these wires could also be longitudinally run within the hollow axial interior 90/91 of the innermost electrical conductor of each antenna 101/102.

Referring again to FIG. 20, each of the antennas 101/102 may be tuned differently such that in one version of the combination antenna 100 each of the antennas 101/102 may transmit a different frequency band, or in another version of the combination antenna 100 each of the antennas 101/102 may transmit a common prescribed frequency band at a different phase or a common phase. This ability to individually control the phase of transmission for each of the antennas 101/102 allows one to individually vary the radio wave radiating direction (e.g., the transmission angle) for each of the antennas 101/102, thus providing the ability to easily and cost-effectively generate a wide range of different custom radio wave radiation patterns—this is particularly advantageous in many different broadcast applications such as AM (amplitude modulation) and FM (frequency modulation) radio, among other types of broadcast applications. It is noted that the combination antenna 100 advantageously combines the radio waves which are transmitted from the individual antennas 101/102 so that these individual radio waves are output from the antenna 100 as a uniform planar wavefront. The aforementioned transmission electronics supply an input power to the combination antenna 100. However, given the foregoing it will be appreciated that the just-described individually different tuning of each of the antennas 101/102 that make up the combination antenna 100 can be accomplished in various ways. For example, an given antenna 101/102 can be individually tuned by using an antenna interface circuit 103/104 that is specifically dedicated to the antenna 101/102, or by altering the length of its conductors and/or their relative diameters, or by a combination of these methods.

It is also noted that although the foregoing subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What has been described above includes example implementations. It is, of course, not possible to describe every conceivable combination of components or methodologies for purposes of describing the claimed subject matter, but one of ordinary skill in the art may recognize that many further combinations and permutations are possible. Accordingly, the claimed subject matter is intended to embrace all such alterations, modifications, and variations that fall within the spirit and scope of the appended claims.

The aforementioned implementations have been described with respect to interaction between several components. It will be appreciated that such implementations and components can include those components or specified sub-components, some of the specified components or sub-components, and/or additional components, and according to various permutations and combinations of the foregoing. Sub-components can also be implemented as components coupled to other components rather than included within parent components (e.g., hierarchical components).

Wherefore, what is claimed is:

1. An antenna for transmitting radio waves, comprising:

two or more individual elongated antennas that are disposed end-to-end along a common longitudinal axis, each of the antennas comprising, an elongated tubular electrical conductor comprising a driven end and an opposite end, and an elongated inner electrical conductor comprising a driven end and an opposite end and a radially cross-sectional shape and size that allow the inner electrical conductor to be longitudinally disposed within a hollow axial interior of the tubular electrical conductor without coming into contact with a radially inner surface of the tubular electrical conductor, the inner electrical conductor being longitudinally disposed within the interior of the tubular electrical conductor such that an axial gap exists between the inner surface of the tubular electrical conductor and a radially outer surface of the inner electrical conductor, the opposite end of the inner electrical conductor being electrically connected to the opposite end of the tubular electrical conductor, a first electrical signal being electrically connected to the driven end of the outer electrical conductor, a second electrical signal being electrically connected to the driven end of the inner electrical conductor, the first and second electrical signals supplying input power to the antenna whenever it is used as a transmitter, said signals supplying output power from the antenna whenever it is used as a receiver, neither of said signals needing to be connected to an electrical ground; and each of the antennas being tuned differently such that each of the antennas transmits one of, a different frequency band, or a common frequency band at a different phase or a common phase.

* * * * *